US007990071B2

(12) United States Patent
Wey et al.

(10) Patent No.: US 7,990,071 B2
(45) Date of Patent: Aug. 2, 2011

(54) LAMP DRIVE CIRCUIT FOR DRIVING A NUMBER OF LAMPS AND BALANCING CURRENTS FLOWING THROUGH THE LAMPS

(75) Inventors: Chin-Der Wey, Miaoli County (TW); Yi-Chun Yeh, Sanchong (TW); Chia-Hung Sun, Kaohsiung (TW); Hsing-Ju Chen, Tainan County (TW)

(73) Assignee: AU Optronics Corp., Hsin-Chu (TW)

( * ) Notice: Subject to any disclaimer, the term of this patent is extended or adjusted under 35 U.S.C. 154(b) by 543 days.

(21) Appl. No.: 11/889,280

(22) Filed: Aug. 10, 2007

(65) Prior Publication Data

US 2007/0278969 A1 Dec. 6, 2007

Related U.S. Application Data

(62) Division of application No. 11/400,383, filed on Apr. 10, 2006, now abandoned.

(30) Foreign Application Priority Data

Aug. 10, 2005 (TW) ..... 94127225 A

(51) Int. Cl.
*H05B 37/00* (2006.01)

(52) U.S. Cl. ..... 315/282; 315/274; 315/291; 315/307; 315/312

(58) Field of Classification Search ..... 315/274–289, 315/224, 225, 247, 246, 209 R, 312–326, 315/291, 307
See application file for complete search history.

(56) References Cited

U.S. PATENT DOCUMENTS

| | | | | |
|---|---|---|---|---|
| 5,936,359 | A | 8/1999 | Gibson | |
| 6,118,223 | A | 9/2000 | Canova | |
| 6,323,602 | B1 | 11/2001 | De Groot et al. | |
| 6,534,934 | B1 | 3/2003 | Lin et al. | |
| 6,717,372 | B2 | 4/2004 | Lin et al. | |
| 7,309,964 | B2 | 12/2007 | Wey et al. | |
| 7,550,929 | B2 * | 6/2009 | Ger et al. | 315/282 |
| 2003/0141829 | A1 | 7/2003 | Yu et al. | |
| 2006/0066246 | A1 | 3/2006 | Ushijima et al. | |
| 2006/0226796 | A1 * | 10/2006 | Chuang | 315/312 |
| 2006/0273745 | A1 | 12/2006 | Wey et al. | |
| 2007/0046218 | A1 | 3/2007 | Ger et al. | |
| 2008/0061711 | A1 | 3/2008 | Jin | |

FOREIGN PATENT DOCUMENTS

JP 2003-031383 1/2003

* cited by examiner

*Primary Examiner* — Tuyet Thi Vo
(74) *Attorney, Agent, or Firm* — Rabin & Berdo, P.C.

(57) ABSTRACT

A lamp drive circuit used for driving a number of lamps is provided. The lamps are used in a backlight module. The backlight module is used for providing a light source when a liquid crystal display displays. The lamps are respectively electrically connected to a coil. The coils have the same number of turns and have the same magnetic circuit, so that the currents flowing through the lamps are balanced.

16 Claims, 25 Drawing Sheets

LAMP DRIVE CIRCUIT FOR DRIVING A NUMBER OF LAMPS AND BALANCING CURRENTS FLOWING THROUGH THE LAMPS

This application is a Divisional Application of U.S. application Ser. No. 11/400,383 filed Apr. 10, 2006 now abandoned; and claims the benefit of Taiwan application Serial No. 94127225, filed Aug. 10, 2005, the subject matter of which is incorporated herein by reference.

BACKGROUND OF THE INVENTION

1. Field of the Invention

The invention relates in general to a liquid crystal display, and more particularly to a lamp drive circuit that balance the currents for the lamp.

2. Description of the Related Art

Liquid crystal display normally adopts the structure of using a set of drive circuits 100 to drive a lamp. The lamp used in the backlight module of the liquid crystal display is used for providing a light source when a liquid crystal display displays. As shown in FIG. 1, a diagram of a conventional lamp drive circuit is shown. A set of drive circuits 100 include a direct current power DC, a switch 102 and the transformer 104. The switch 102 is used for converting the direct voltage outputted by the direct current power DC into an alternate (alternating (AC)) voltage to the transformer 104, so that the transformer 104 accordingly generates the alternate voltage level capable of driving the lamp 106.

Along with the increase in the size of the liquid crystal display, the large-sized liquid crystal TV for instance, the backlight module has to provide a higher luminance so as to maintain the display quality. In order to improve the luminance of the backlight module, not only the size of the lamp needs to be enlarged, but also the number of the lamp used needs to be increased.

In order to reduce the cost of driving a number of lamps, a conventional practice is to drive a number of lamps by a set of drive circuits 100. Referring to FIG. 2, a diagram of another example of the conventional lamp drive circuit is shown. By electrically connecting a number of lamps 106 (1)~106 (N) connected in parallel, where N is a positive integer, fewer transformers 104 and switches 102 are used, so that the costs are reduced.

Despite the above practice reduces costs, the application is subject to the characteristics of the lamps 106. That is, the impedance of each lamp 106 is different, so that each current flowing through each lamp 106 is different. Consequently, each lamp 106 is different luminance, resulting in a non-informal distribution of the luminance of the backlight module which deteriorates the display quality of the liquid crystal display. Therefore, how to reduce the cost and at the same time maintaining the balance of the currents has become an imminent issue to be resolved.

SUMMARY OF THE INVENTION

It is therefore an object of the invention to provide a lamp drive circuit used for driving a number of lamps and balancing the currents flowing through the lamps. By doing so, the luminance of the light source provided to the liquid crystal display panel by the backlight module is more uniformed, the currents for the lamps are more balanced, and the durability of the lamps is further prolonged.

The invention achieves the above-identified object by providing a lamp drive circuit used for driving a first lamp and a second lamp. The lamp drive circuit includes a power supply circuit and at least a balance circuit. The power supply circuit provides an alternate (alternating (AC)) voltage. The balance circuit is for receiving the alternate voltage and driving the first lamp and the second lamp. The balance circuit at least includes a first coil and a second coil. One end of the first coil is for receiving the alternate voltage, and the other end of the first coil is for outputting a first current to the first lamp. One end of the second coil is for receiving the alternate voltage, and the other end of the second coil is for outputting a second current to the second lamp. The voltage across the first coil corresponds to the voltage across the second coil.

Other objects, features, and advantages of the invention will become apparent from the following detailed description of the preferred but non-limiting embodiments. The following description is made with reference to the accompanying drawings.

DETAILED DESCRIPTION OF THE INVENTION

The invention provides a lamp drive circuit used for driving a number of lamps. The lamps are used in a backlight module. The backlight module is used for providing a light source when a liquid crystal display displays. The lamps are respectively electrically connected to a coil. The coils substantially have the same coil turns (i.e., number of turns) and have the same magnetic circuit, so that the currents flowing through the lamps are balanced. By doing so, the luminance of the light source provided to the liquid crystal display panel by the backlight module is more uniform, the currents for flowing through the lamps are more balanced, and the durability of the lamps is further prolonged.

Figure 1:
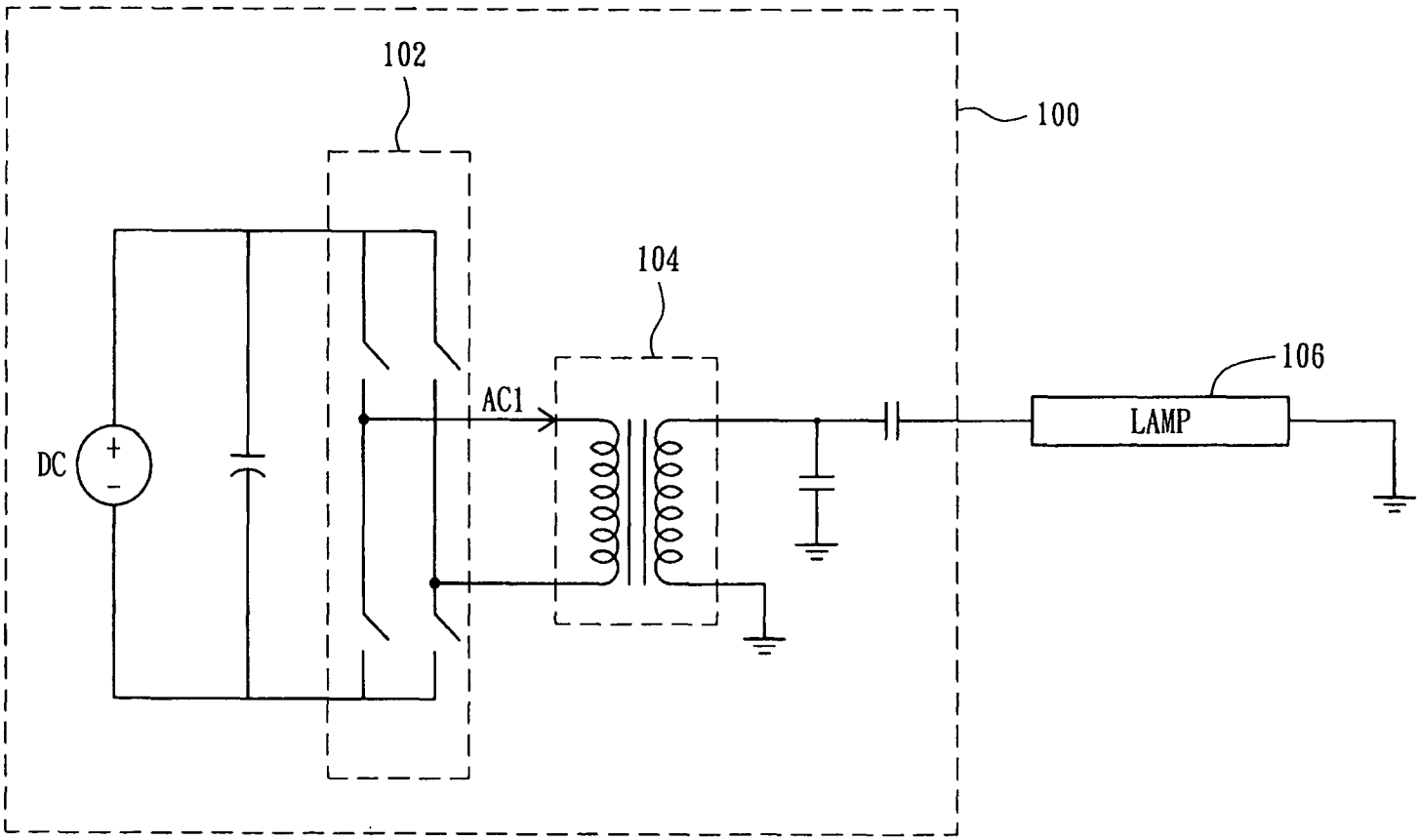
FIG. 1(RELATED ART)
FIG. 1 is a diagram of a conventional lamp drive circuit.
Figure 2:
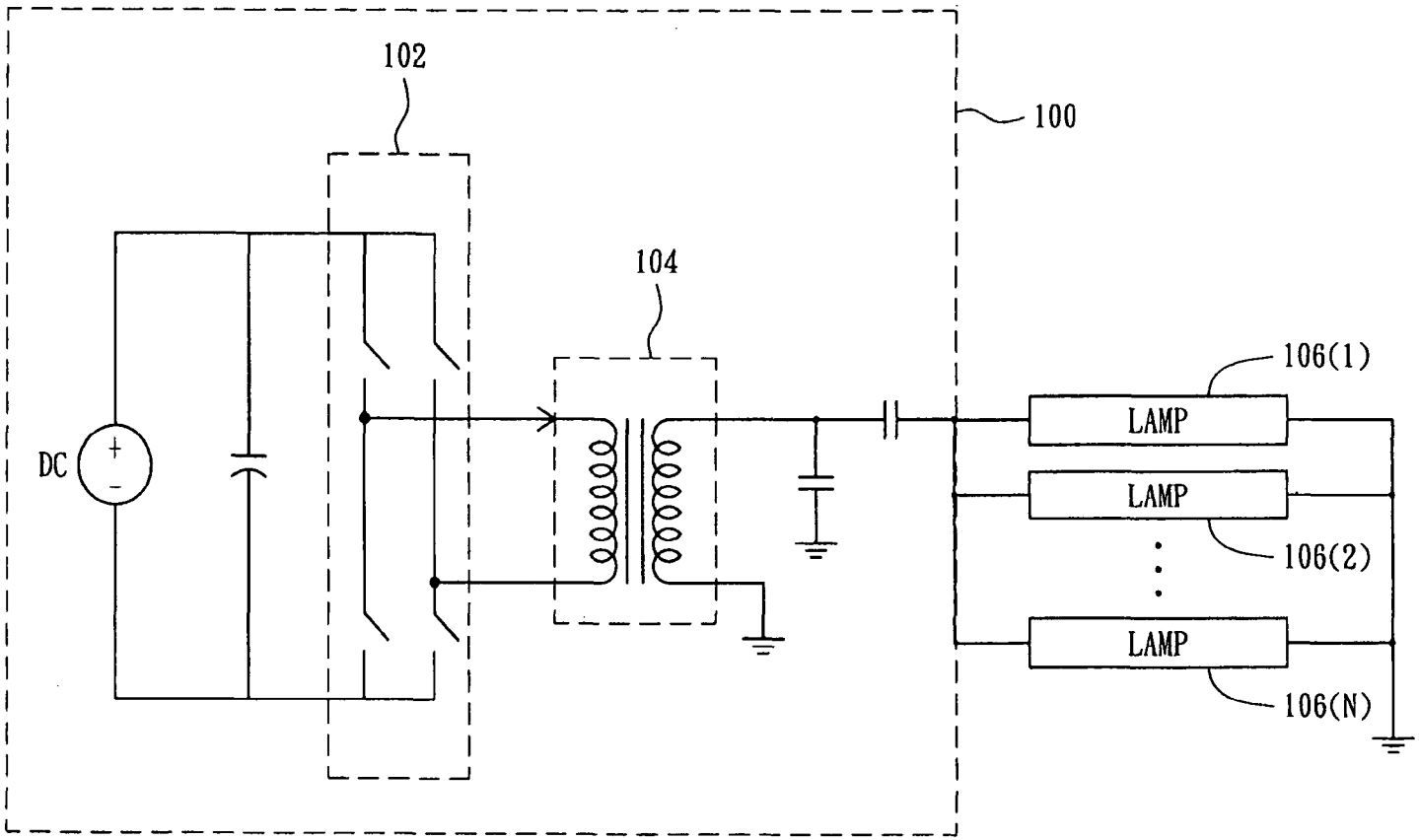
FIG. 2(RELATED ART)
FIG. 2 is a diagram of another example of the conventional lamp drive circuit.
Figure 3:
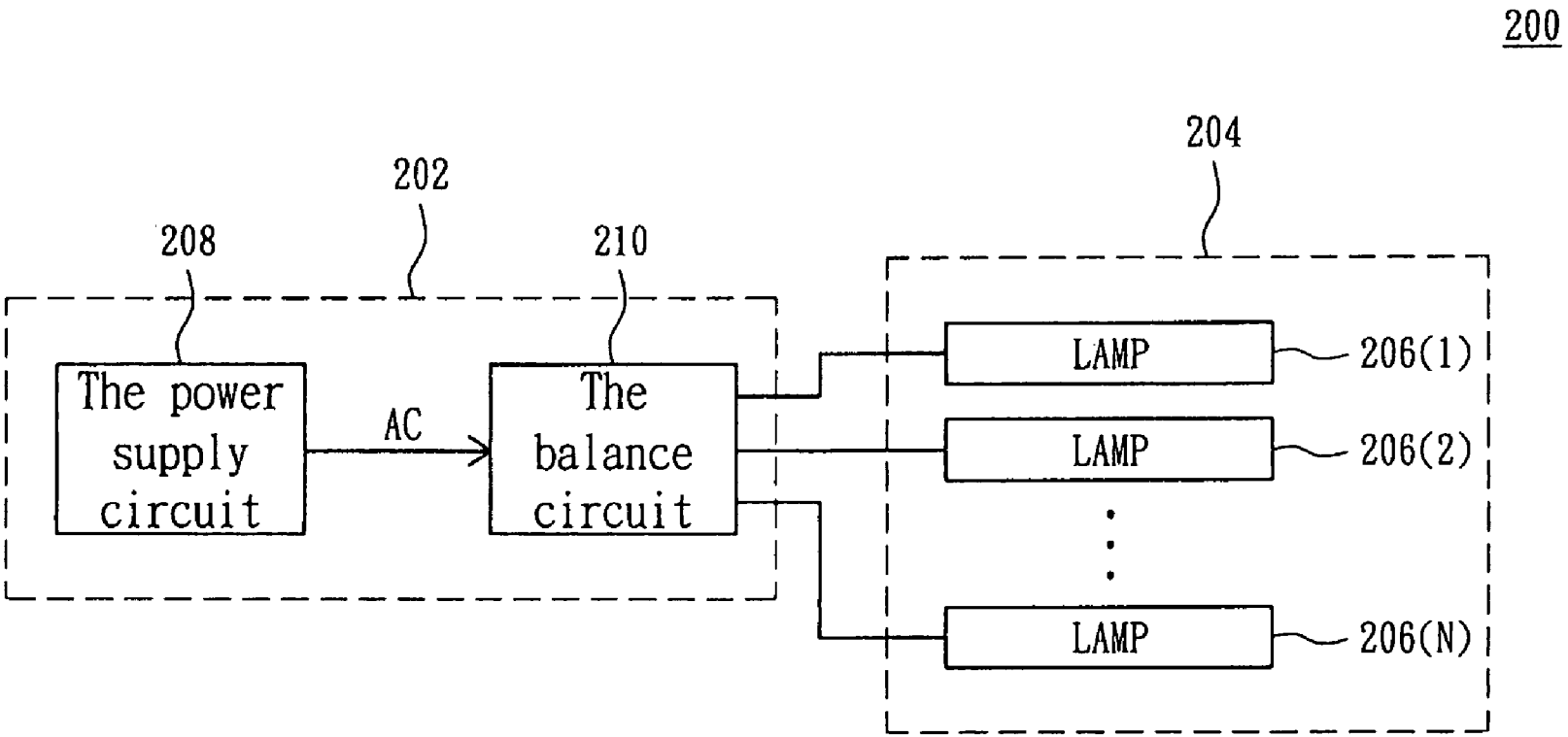
FIG. 3 is a diagram of a liquid crystal display.

Referring to FIG. 3, a diagram of a liquid crystal display is shown. The liquid crystal display 200 includes a lamp drive circuit 202 and a backlight module 204. The lamp drive circuit 202 is used for driving a number of lamps 206 (1)~206 (N), where N is a positive integer. The lamps 206 (1)~206 (N) are used in the backlight module 204 for providing a light source when the liquid crystal display 200 displays. The lamp drive circuit 202 may include a power supply circuit 208 and a balance circuit 210 for instance. The power supply circuit 208 is used for providing an alternate (alternating) voltage AC. The balance circuit 210 is for receiving the alternate voltage AC, driving a number of lamps 206 (1)~206 (N) according to the alternate voltage AC, and the balance circuit 210 balances the currents flowing through the lamps 206 (1)~206 (N). The invention is exemplified by two embodiments disclosed below.

First Embodiment

Figure 4A:
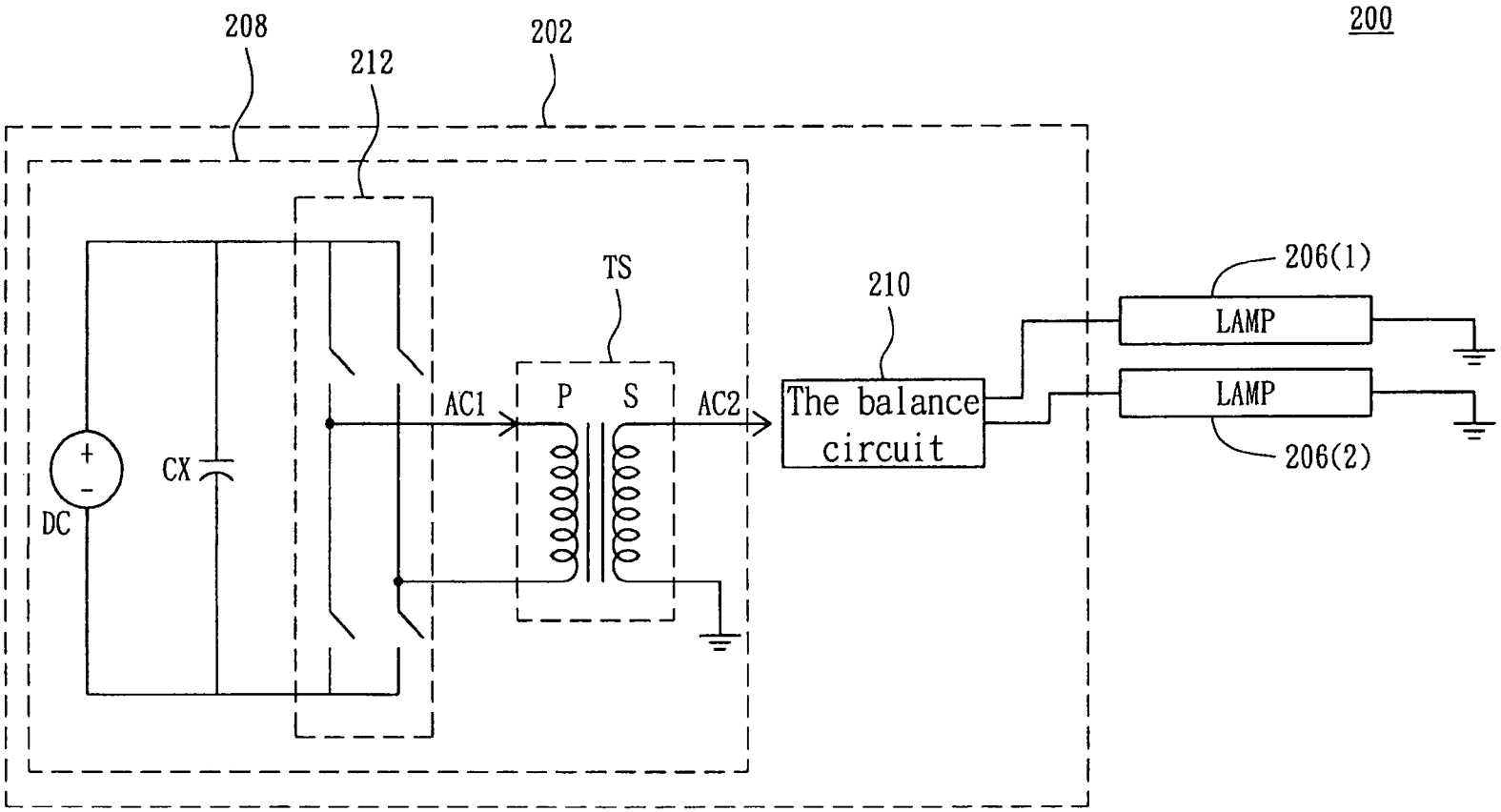
FIG. 4A is a diagram of an example of a lamp drive circuit 202 according to a first embodiment of the invention.

The embodiment is exemplified by the situation of driving two lamps, namely a first lamp 206 (1) and a second lamp 206 (2), and a balance circuit 210. Referring to FIG. 4A, a diagram of an example of a lamp drive circuit 202 according to a first embodiment of the invention is shown. The power supply circuit 208 may include a transformer TS, a direct current power DC and a switch 212 for instance. The transformer TS has a primary coil P and a secondary coil S. The primary coil P, for example, receives an alternate voltage AC1 provided by a liquid crystal display 200. The switch 212 is for switching the direct voltage outputted by the direct current power DC to the alternate voltage AC1, so that the transformer TS according to the alternate voltage AC1 generates the alternate voltage level, that is, the alternate voltage AC2, which is capable of driving the first lamp 206 (1) and the second lamp 206 (2). The alternate voltage AC1 received by the transformer TS can be generated either by converting the above direct current power DC by the switch 212 or by converting an electric supply, such as an AC110 for instance, into the alternate voltage AC1 by an energy converter. The present embodiment does not restrict the source of the alternate voltage AC1 received by the transformer TS. Any alternate voltage AC1 which can accordingly generate the alternate voltage level (the alternate voltage AC2) capable of driving the first lamp 206 (1) and the second lamp 206 (2) would do.

Figure 5:
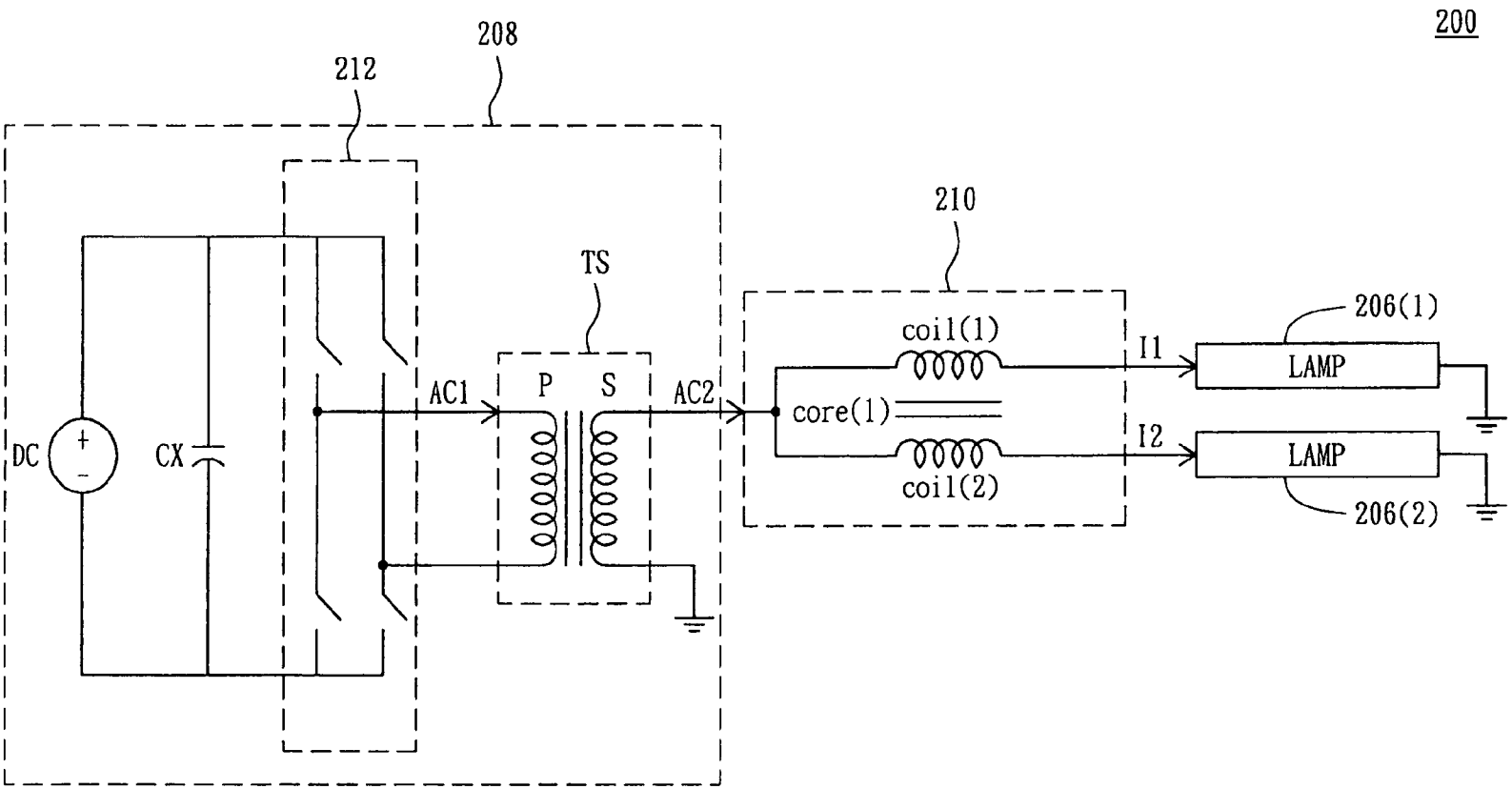
FIG. 5 is a diagram of an example of a balance circuit 210.

Referring to FIG. 5, a diagram of an example of a balance circuit 210 is shown. Take the structure illustrated in FIG. 4A for example. The balance circuit 210 includes a first coil coil (1) and a second coil coil (2). One end of the first coil coil (1) is for receiving the alternate voltage AC2, while the other end is for outputting the first current I1 to the first lamp 206 (1). One end of the second coil coil (2) is for receiving the alternate voltage AC2, while the other end is for outputting the second current I2 to the second lamp 206 (2). The first coil coil (1) and the second coil coil (2) are both wound around the same core core (1), and the first coil coil (1) and the second coil coil (2) substantially have the same coil turns. The voltage across the first coil coil (1) corresponds to the voltage across the second coil coil (2). That is, the first coil coil (1) and the second coil coil (2) induct the same magnetic circuit, so that the currents I1 and I2 are almost the same. Therefore, the first lamp 206 (1) and the second lamp 206 (2) almost have the same luminance, and ultimately the luminance of the backlight module is further uniform. Moreover, the currents I1 and I2 are balanced, further prolonging the durability of the lamps 206 (1) and 206 (2).

Figure 6:
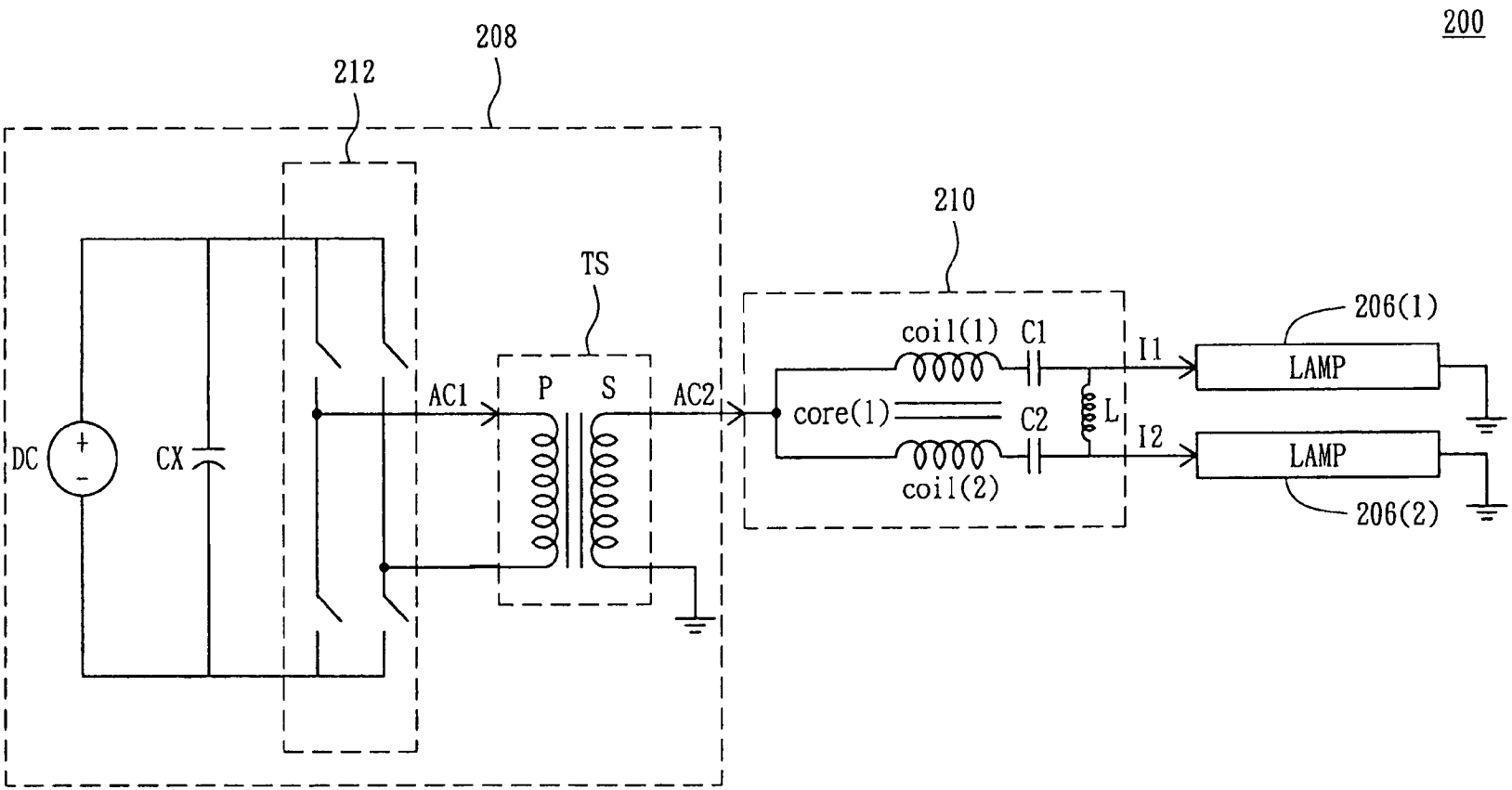
FIG. 6 is a diagram of a second example of the balance circuit 210.

The first coil coil (1) and the second coil coil (2) can achieve a better balance effect by impedance matching. Referring to FIG. 6, a diagram of a second example of the balance circuit 210 is shown. The balance circuit 210 further includes a matching inductor L, a first capacitor C1 and a second capacitor C2. The other end of the first coil coil (1) is coupled to one end of the inductor L via the first capacitor C1. The other end of the second coil coil (2) coupled to the other end of the inductor L via the second capacitor C2. That is to say, the balance circuit 210 can achieve a better current balancing effect by means of appropriately selected impedance values of the inductor L and the capacitors C1, C2.

Figure 7:
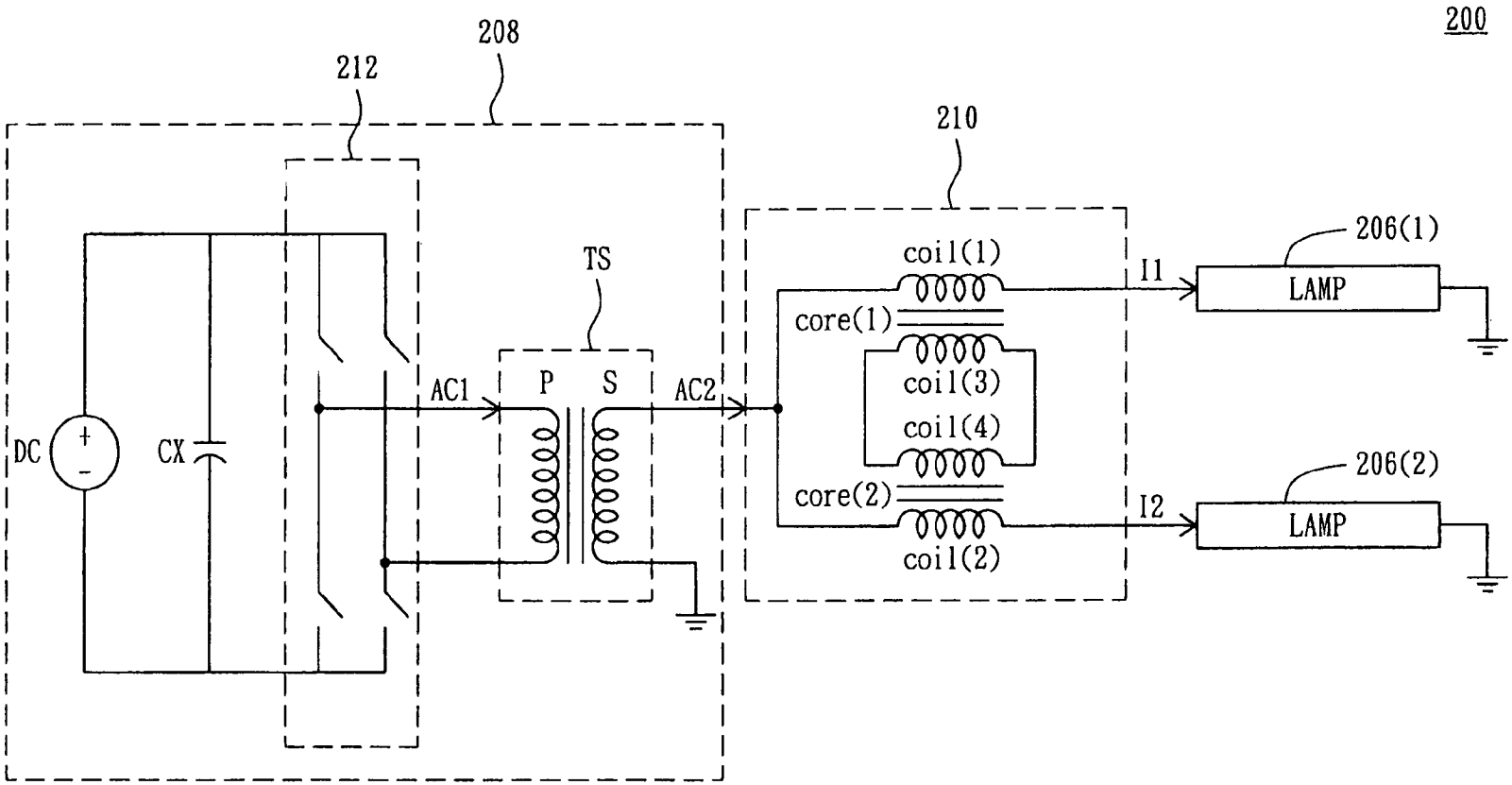
FIG. 7 is a diagram of a third example of the balance circuit 210.

Referring to FIG. 7, a diagram of a third example of the balance circuit 210 is shown. Similarly, the structure of FIG. 4A is illustrated as an example. The balance circuit 210 further includes a second core core (2), a third coil coil (3) and a fourth coil coil (4). The first coil coil (1), the second coil coil (2), the third coil coil (3) and the fourth coil coil (4) substantially have the same coil turns. The third coil coil (3) and the first coil coil (1) are both wound around the first core core (1) while the third coil coil (3) and the fourth coil coil (4) form a closed loop. The fourth coil coil (4) and the second coil coil (2) are both wound around the second core core (2). Similarly, by sharing the same magnetic circuit, that is, the first coil coil (1) and the second coil coil (1) share the same magnetic circuit, so that the first coil coil (1) and the third coil coil (3) sense the same voltage. Moreover, the third coil coil (3) and the fourth coil coil (4) form the same loop and have the same coil turns, so the voltages across the third coil coil (3) and the fourth coil coil (4) are the same. Then, the second coil coil (2) and the fourth coil coil (4) also share the same magnetic circuit, so that the second coil coil (2) and the fourth coil coil (4) sense the same voltage. Lastly, the first current I1 and the second current I2 would be balanced automatically.

Figure 8:
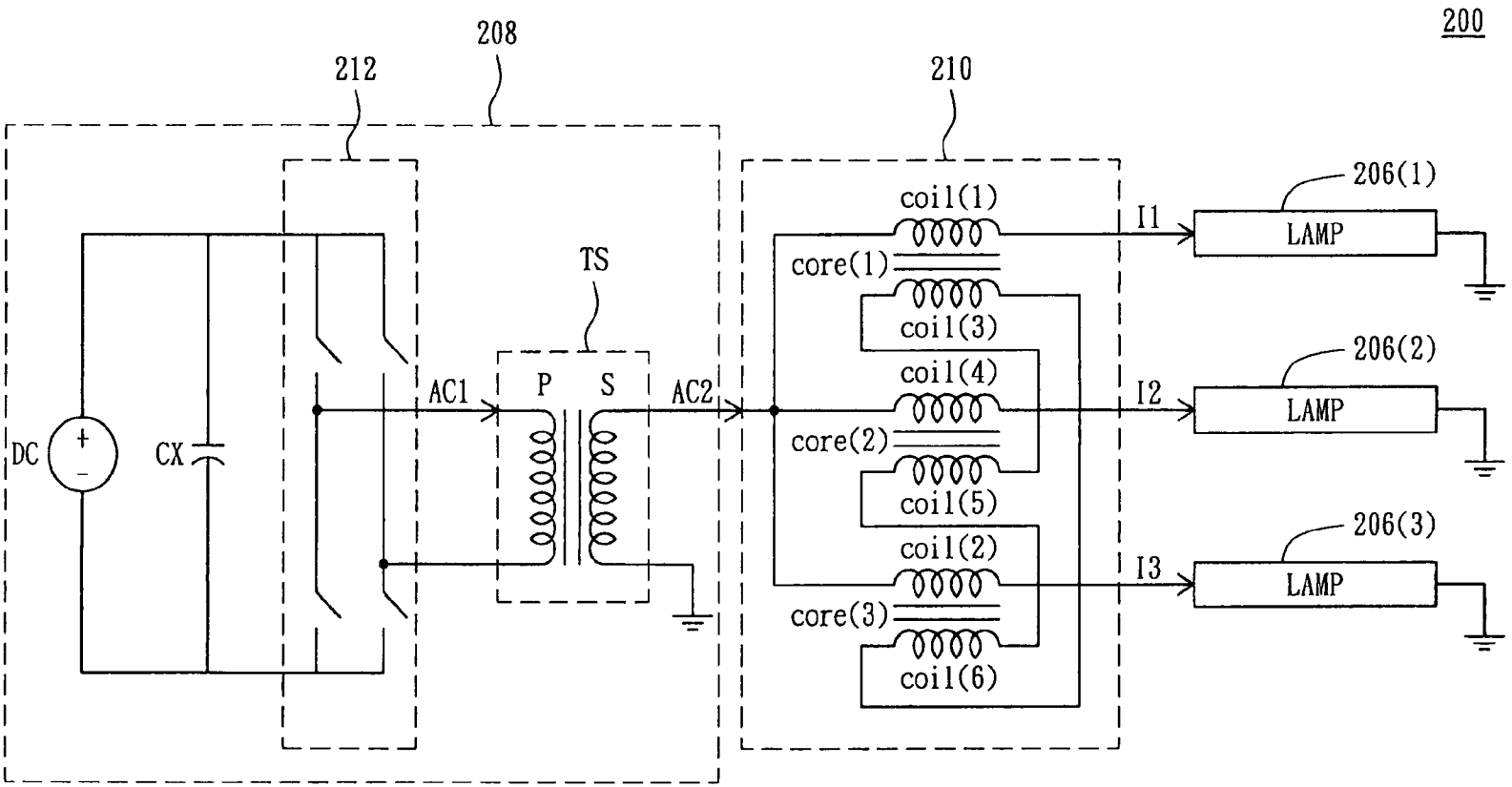
FIG. 8 is a diagram of a fourth example of the balance circuit 210.

Similarly, referring to FIG. 8, a diagram of a fourth example of the balance circuit 210 is shown. Now the balance circuit 210 is used to drive three lamps. The balance circuit 210 further includes a second core core (2), a third core core (3), a third coil coil (3), a fourth coil coil (4), a fifth coil coil (5) and a sixth coil coil (6). The third coil coil (3), the fourth coil coil (4), the fifth coil coil (5) and the sixth coil coil (6) substantially have the same coil turns. The third coil coil (3) and the first coil coil (1) are both wound around the first core core (1). The fourth coil coil (4) and the fifth coil coil (5) are both wound around the second core core (2). The second coil coil (2) and the sixth coil coil (6) are both wound around the third core core (3). The third coil coil (3), the fifth coil coil (5) and the sixth coil coil (6) form a closed loop. The first coil coil (1), the second coil coil (2) and the fourth coil coil (1) all have one end for receiving the second alternate voltage AC2 and have the other end for outputting the first current I1, the second current I2 and the third current I3 respectively. As are disclosed in the explanation of FIG. 7, the first current I1, the second current I2 and the third current I3 would be balanced automatically. To summarize, within the capacity of the above-mentioned transformer TS, the balance circuit 210 is able to drive more than three lamps 206. That is to say, each lamp 206 is respectively connected in serial to its corresponding coil (coil) such as the first coil coil (1), the second coil coil (2) and the fourth coil coil (4) in FIG. 8 for instance. The coils, coils (1), coil (2) and coil (4), are respectively wound around the same core (core) with their corresponding coils such as the third coil coil (3), the fifth coil coil (5) and the sixth coil coil (6) in FIG. 8 for instance, so that the coils, coils (3), coil (5) and coil (6), form a closed loop. Lastly, the currents flowing through the lamps 206 are balanced.

Figure 9:
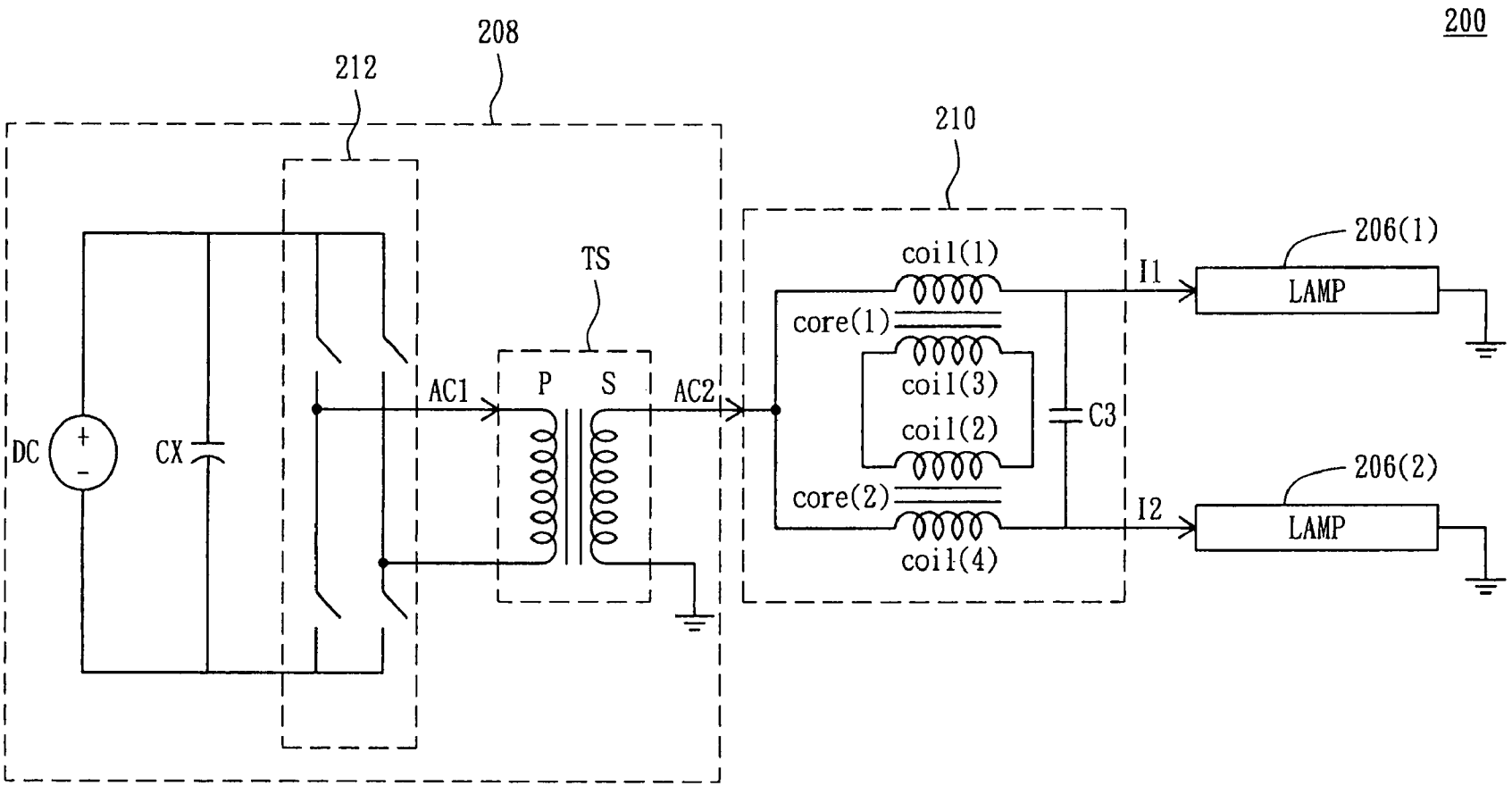
FIG. 9 is a diagram of a fifth example of the balance circuit 210.
Figure 10:
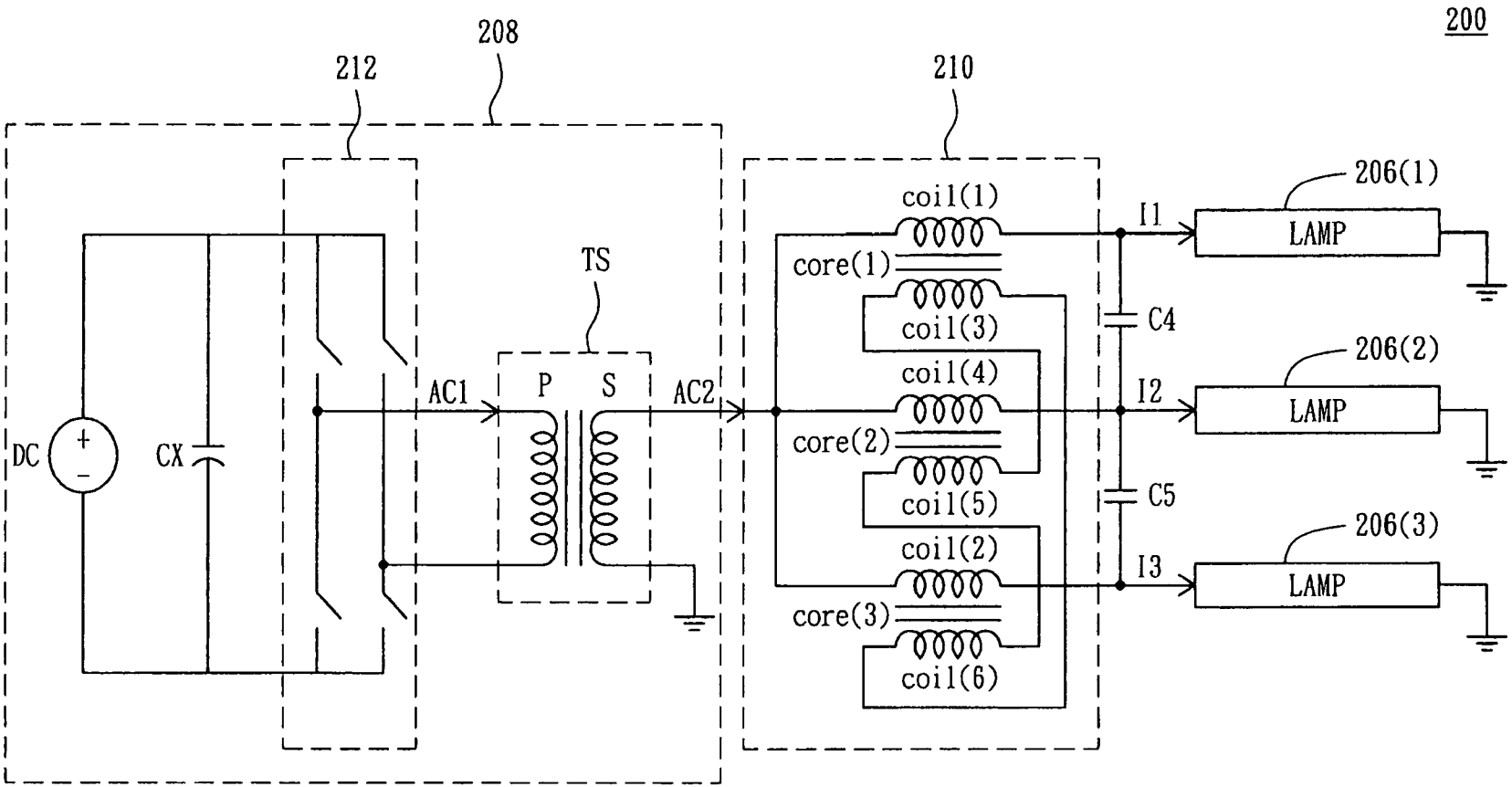
FIG. 10 is a diagram of a sixth example of the balance circuit 210.

A capacitor can be connected across output ends of the balance circuit 210 to achieve a better current balancing effect. As shown in FIG. 9, a diagram of a fifth example of the balance circuit 210 is shown. FIG. 9 is exemplified by the structure of FIG. 7. The balance circuit 210 further includes a third capacitor C3. The third capacitor C3 is connected across the output ends of the balance circuit 210. Or, referring to FIG. 10, a diagram of a sixth example of the balance circuit 210 is shown. FIG. 10 is exemplified by the structure of FIG. 8. The balance circuit 210 further includes a fourth the capacitor C4 and a fifth the capacitor C5. The fourth capacitor C4 is connected across the input end of lamp 206 (1) and the input end of the lamp 206 (2). The fifth capacitor C5 is connected across the input end of the lamp 206 (2) and the input end of the lamp 206 (3). Besides, the above-mentioned capacitors C3, C4 and C5 respectively can be divided into two capacitors. For example, the third capacitor C3 is divided into the capacitors C3 (1) and C3 (2). The capacitors C4 (1), C4 (2), C5 (1) and C5 (2) all have one end being coupled to its corresponding output end and the other end being coupled to the ground voltage.

Figure 11:
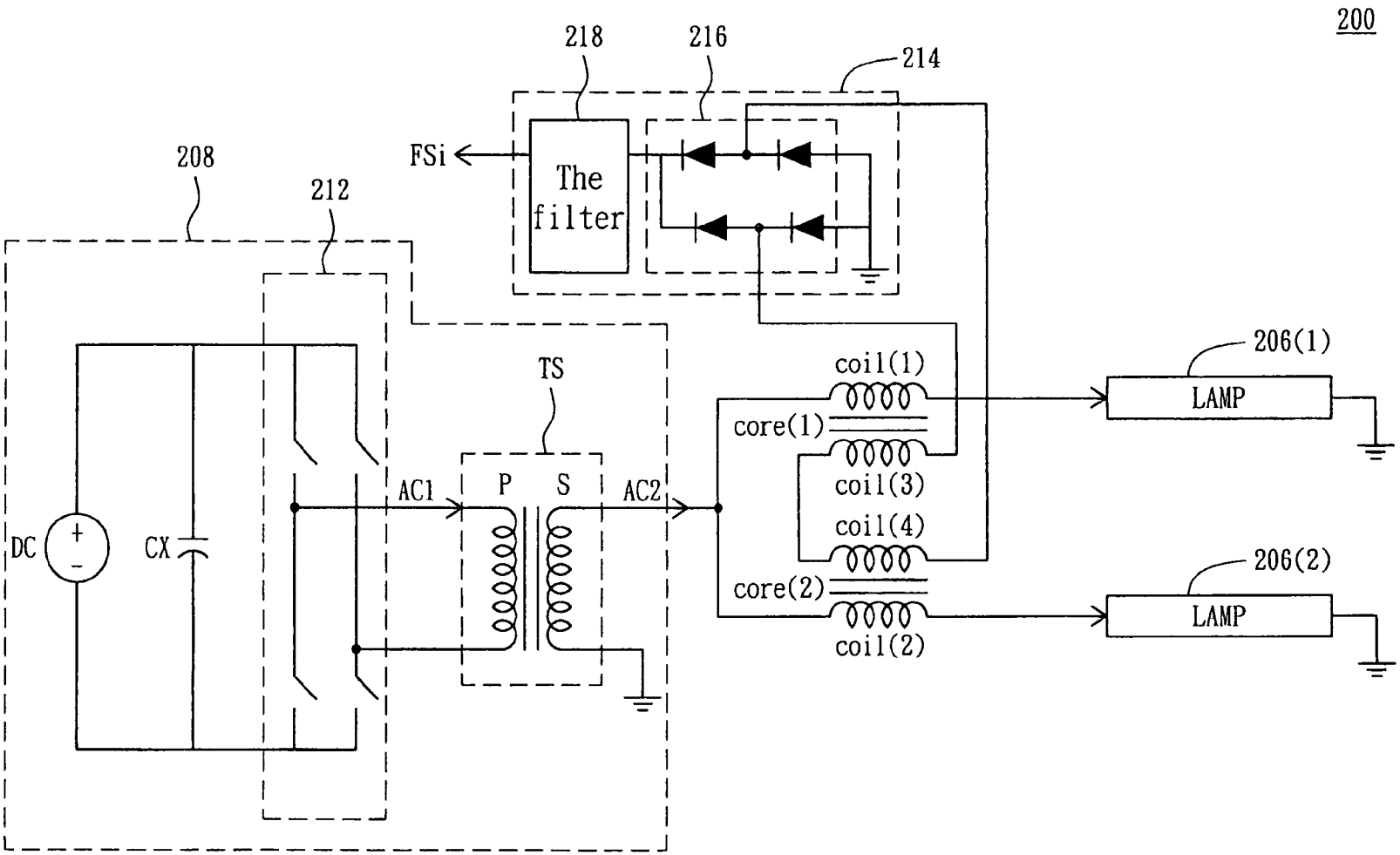
FIG. 11 is a diagram of an example showing a feedback circuit being disposed on a lamp drive circuit.

Next, the feedback aspect is discussed. The above-mentioned lamp drive circuit 202 further includes a feedback circuit 214. The feedback circuit 214 is for outputting a feedback signal FSi according to the electric signal required for driving the lamp 206. The lamp drive circuit 202 adjusts the operating period of the switch 212 according to the feedback signal FSi, so that the lamp 206 can achieve the required luminance and maintain stable. Referring to FIG. 11, a diagram of an example showing a feedback circuit being disposed on a lamp drive circuit is shown. In the balance circuit 210, part of the coils (coil) forms a closed loop, such as the structure disclosed in FIG. 7 and FIG. 8 for instance, the required electric signal is obtained from the closed loop and converted into the feedback signal FSi. For example, the feedback circuit 214 can obtain the required electric signal from the loop formed by the third coil coil (3) and the fourth coil coil (4), that is, the voltage difference between the third coil coil (3) and the fourth coil coil (4), so as to output the corresponding feedback signal FSi and achieve the above object. The feedback circuit 214 includes a full/half-wave rectifier circuit 216 and a filter 218. The full/half-wave rectifier circuit 216 is for rectifying and outputting the above voltage difference to the filter 218, so that the filter 218 filters the noises of the rectified voltage difference to become the feedback signal FSi.

Figure 4B:
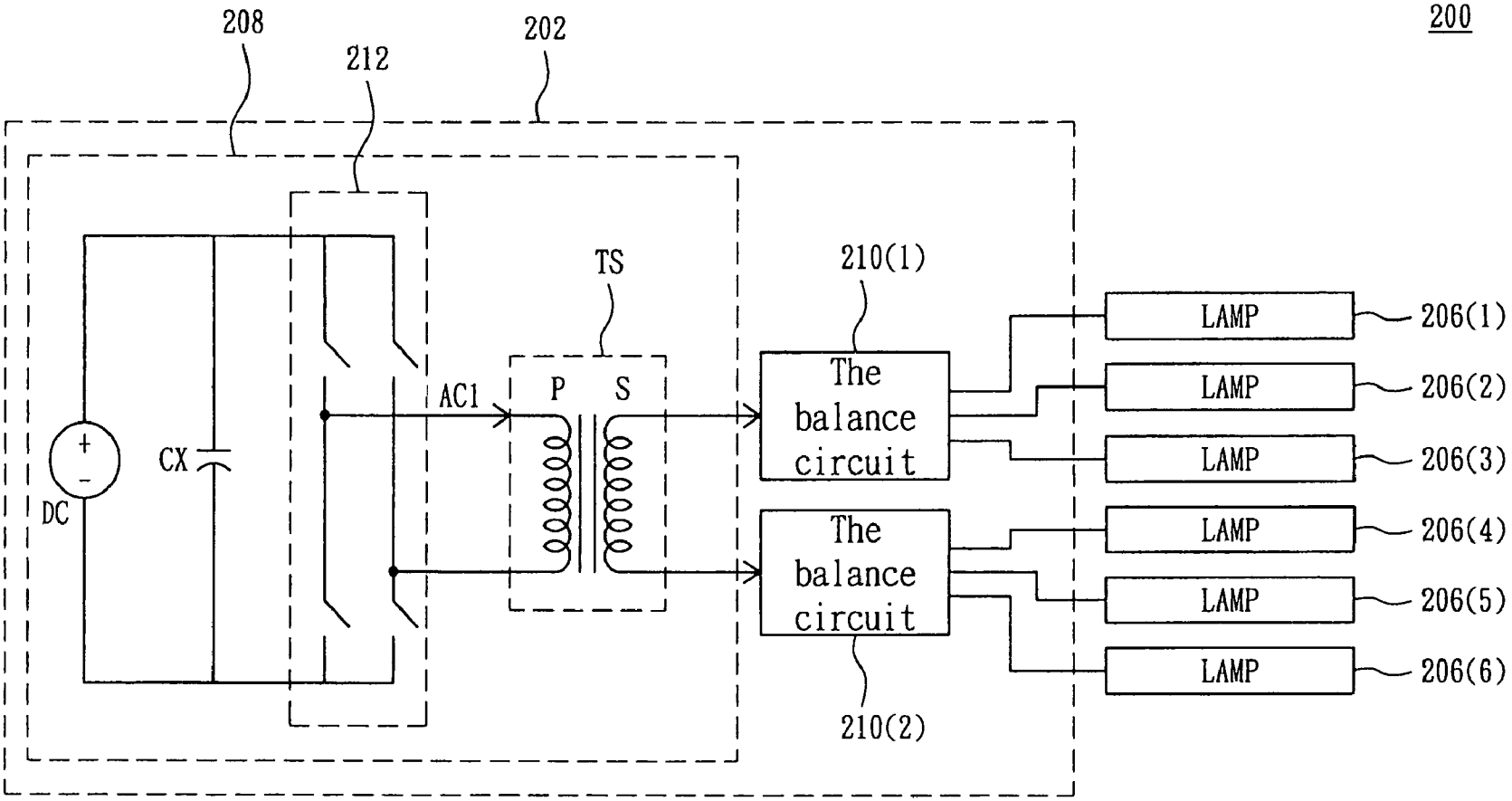
FIG. 4B is a diagram of another example of the lamp drive circuit 202 according to a first embodiment of the invention.
Figure 24:
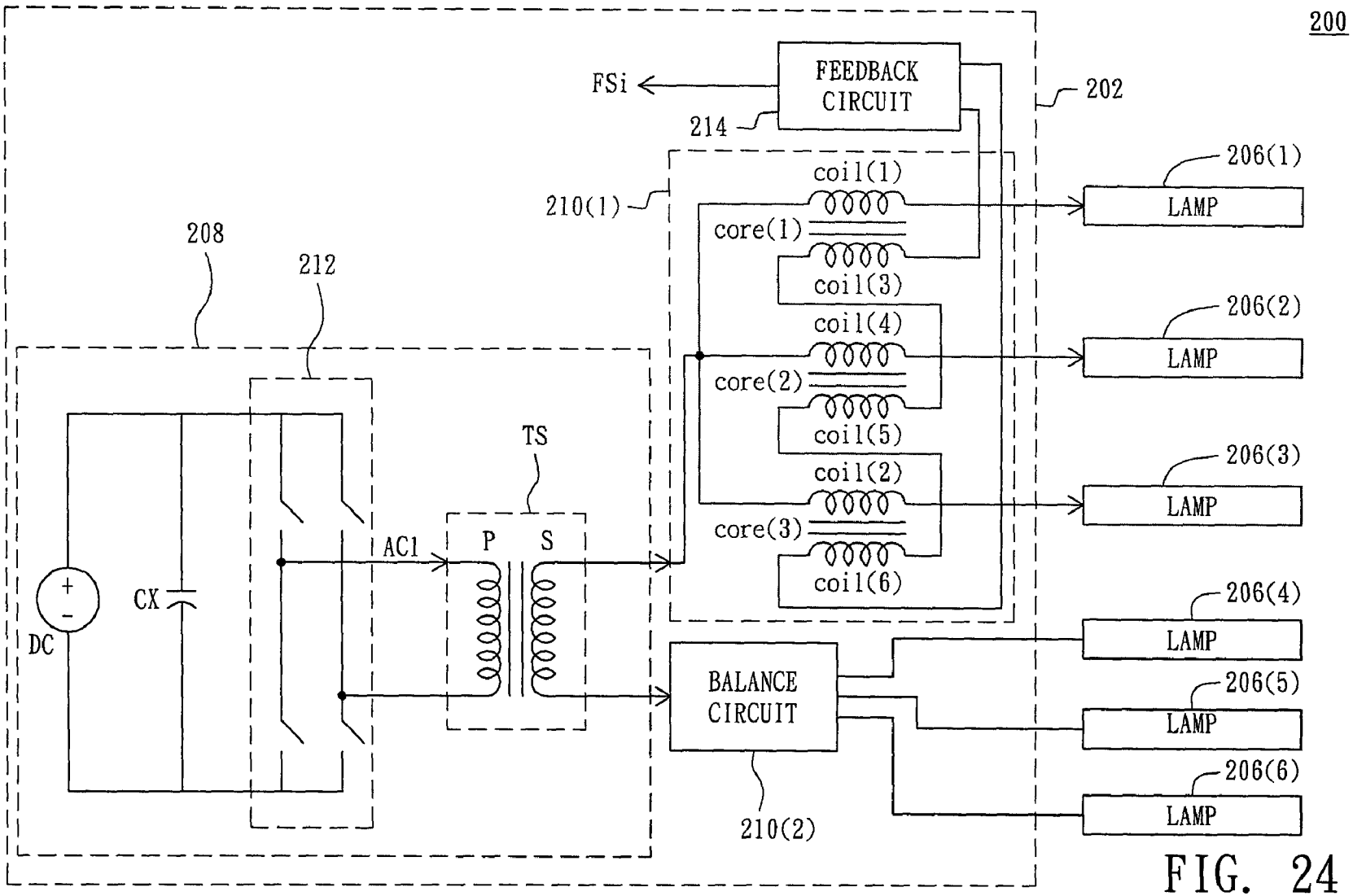
FIG. 24 is a diagram of an example showing a feedback circuit being disposed on a lamp drive circuit 202 based on FIGS. 4B and 8.

Next, referring to FIG. 4B, a diagram of another example of the lamp drive circuit 202 according to a first embodiment of the invention is shown. The above disclosures illustrate the situation of using a balance circuit 210 to drive a number of lamps. However, the lamp drive circuit 202 further includes another balance circuit, that is, the original first balance circuit 210 (1) plus a second balance circuit 210 (2). The first balance circuit 210 (1) and the second balance circuit 210 (2) can both have the structures disclosed in FIGS. 5~10. Each of the balance circuits 210 respectively drives its corresponding lamps. FIG. 4B is exemplified by the structure of the balance circuit 210 in FIG. 8. A set of drivers, that is, the lamp drive circuit 202, can drive six lamps 206 (1)~206 (N) at the same time and resolve the above imbalance problem of the currents, thereby reducing the cost of driving a number of lamps the required. Further, FIG. 24 illustrates an example showing a feedback circuit 214 being disposed on a lamp drive circuit 202 based on FIGS. 4B and 8. In FIG. 24, the feedback circuit 214 in FIG. 24 outputs a feedback signal FSi according to a voltage difference between one end of the third coil (3) and one end of the sixth coil (6) in the first balance circuit 210 (1).

It is noteworthy that the impedance of the coil needs to be considered. A certain corresponding relationship exists between each coil and the impedance of the lamp. It is known from experiment that when the impedance of the coil is far larger than the impedance of the lamp, the balance effect becomes even better. However, the larger the impedance of the coil is, the more power consumption will be. The impedance of the coil must be larger than the impedance of the lamp at least by ⅕, so as to achieve a certain level of balance effect of the currents.

Second Embodiment

Figure 12:
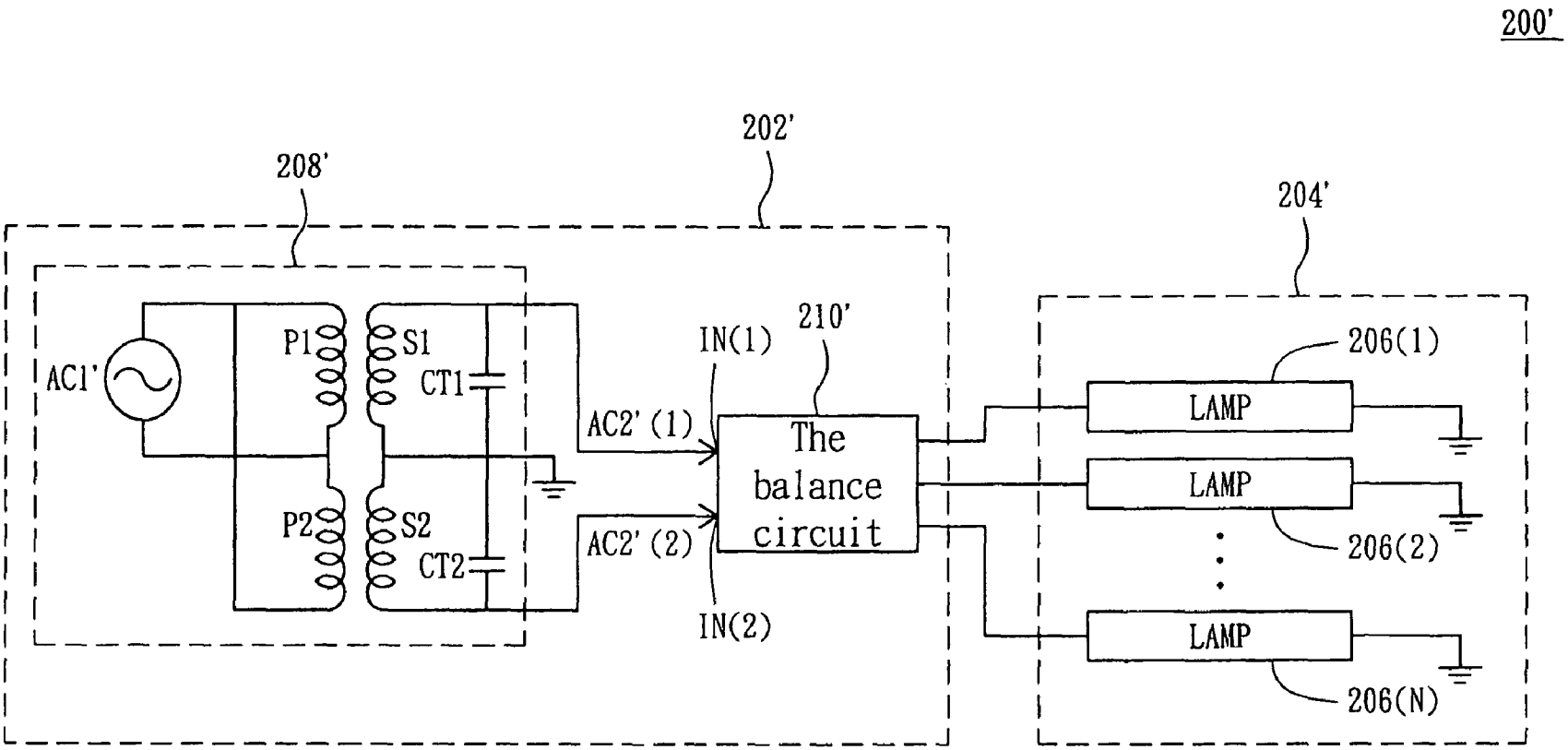
FIG. 12 is a diagram of a lamp drive circuit 202' according to a second embodiment of the invention.

The second embodiment differs with the first embodiment in that the structure of the balance circuit is changed into double-end input. That is, the second embodiment has two input ends, namely, the first input end IN (1) and the second input end IN (2). Referring to FIG. 12, a diagram of a lamp drive circuit 202' according to a second embodiment of the invention is shown. The liquid crystal display 200' includes a lamp drive circuit 202' and a backlight module 204'. The lamp drive circuit 202' also includes a power supply circuit 208' and a balance circuit 210'. It is noteworthy that the power supply circuit 208' includes two primary coils P1 and P2 and two secondary coils S1 and S2. The two primary coils P1 and P2 both receive a first alternate voltage AC1'. The first alternate voltage AC1' is the same as in the first embodiment. That is, the alternate voltage AC1 can be generated either by converting the above direct current power by the switch or by converting an electric supply, such as an AC 110 for instance, into the alternate voltage by an energy converter. The direct current power and the switch are not illustrated here. The two secondary coils S1 and S2 are connected in serial, and their common point can be connected to a ground voltage GND or can be floating. For example, in FIG. 12, the common point between the secondary coils-S1 and S2 is coupled to the ground voltage, so that the first input end IN (1) and the second input end IN (2) have the same polarity of voltage. The two ends of the secondary coils S1 and S2 are respectively connected to capacitors CT1 and CT2 in parallel. That is, the two ends of the secondary coil S1 and the capacitor CT1 are connected in parallel, while the two ends of the secondary coil S2 and the capacitor CT2 are connected in parallel. The two secondary coils S1 and S2 respectively output the second alternate voltages AC2' (1) and AC2' (2) to the two input ends IN (1) and IN (2) the balance circuit 210'. The balance circuit 210' is for receiving the second alternate voltage AC2' (1) and AC2' (2) and accordingly outputting a number of lamps 206 (1)~206 (N), and then balancing the currents flowing through the lamps 206 (1)~206 (N), where N is a positive integer.

Figure 13:
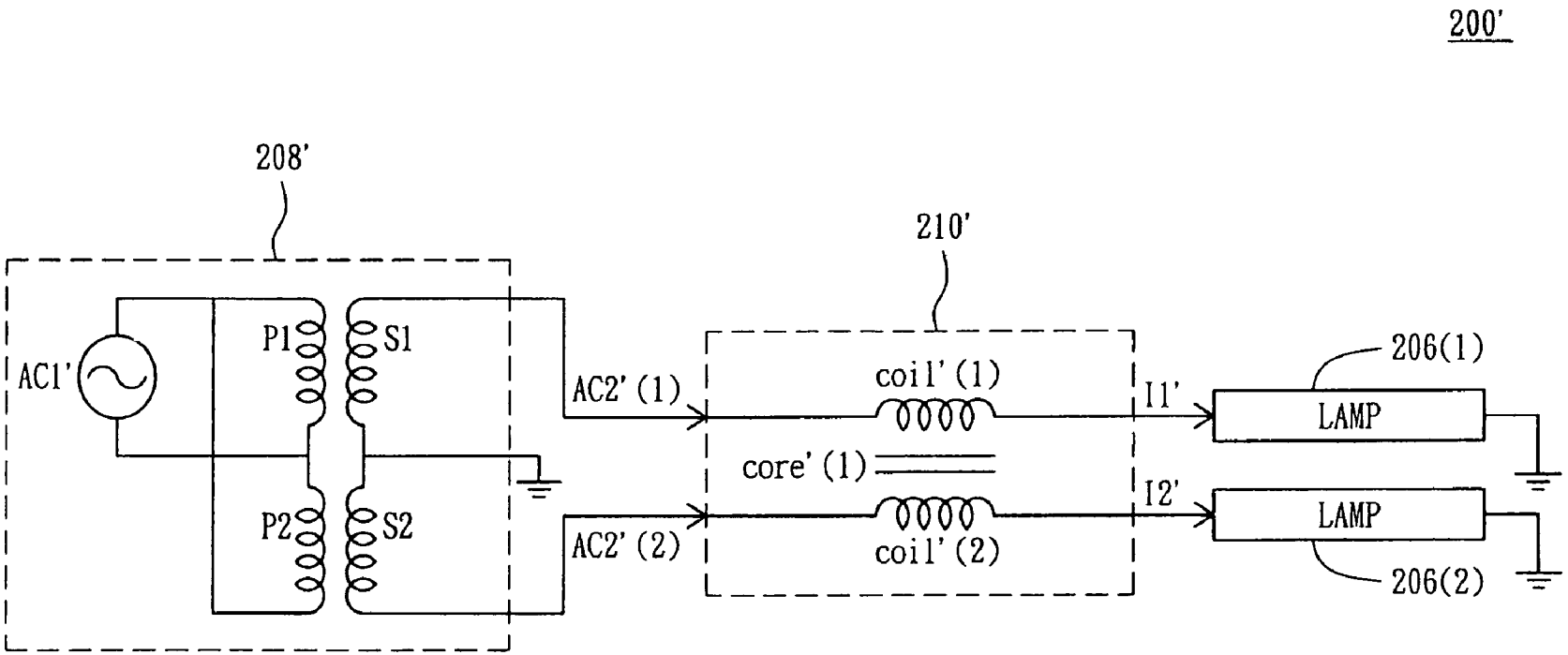
FIG. 13 is a diagram of an example of a balance circuit 210'.

Firstly, the embodiment is exemplified by the situation of driving two lamps, namely, the first lamp 206 (1) and the second lamp 206 (2). Referring to FIG. 13, a diagram of an example of a balance circuit 210' is shown. The balance circuit 210' includes a first coil coil' (1) and a second coil coil' (2). The first coil coil' (1) has one end, the first input end IN (1), for receiving the alternate voltage AC2' (1) and the other end for outputting the first current I1' to the first lamp 206 (1). The second coil coil' (2) has one end, the first input end IN (2), for receiving the alternate voltage AC2' (2), and has the other end for outputting the second current I2' to the second lamp 206 (2). The first coil coil' (1) and the second coil coil' (2) are both wound around the core core' (1), while the first coil coil' (1) and the second coil coil' (2) substantially have the same coil turns. According to the principle of balancing disclosed above, the first lamp 206 (1) and the second lamp 206 (2) would have almost the same luminance. Lastly, the backlight module would have an even uniformed luminance and the currents I1' and I2' are even more balanced, so that the first lamp 206 (1) and the second lamp 206 (2) would have a longer durability.

Figure 14:
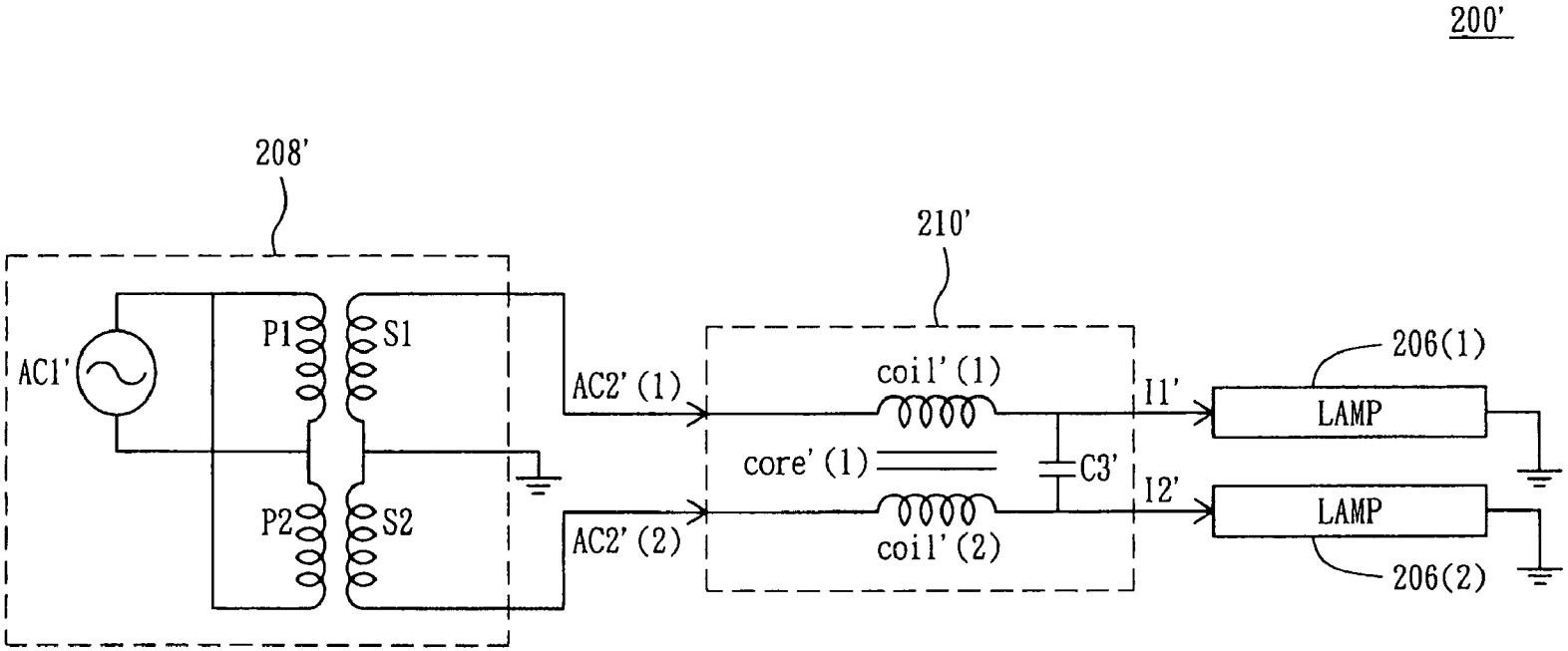
FIG. 14 is a diagram of a second example of the balance circuit 210'.
Figure 15:
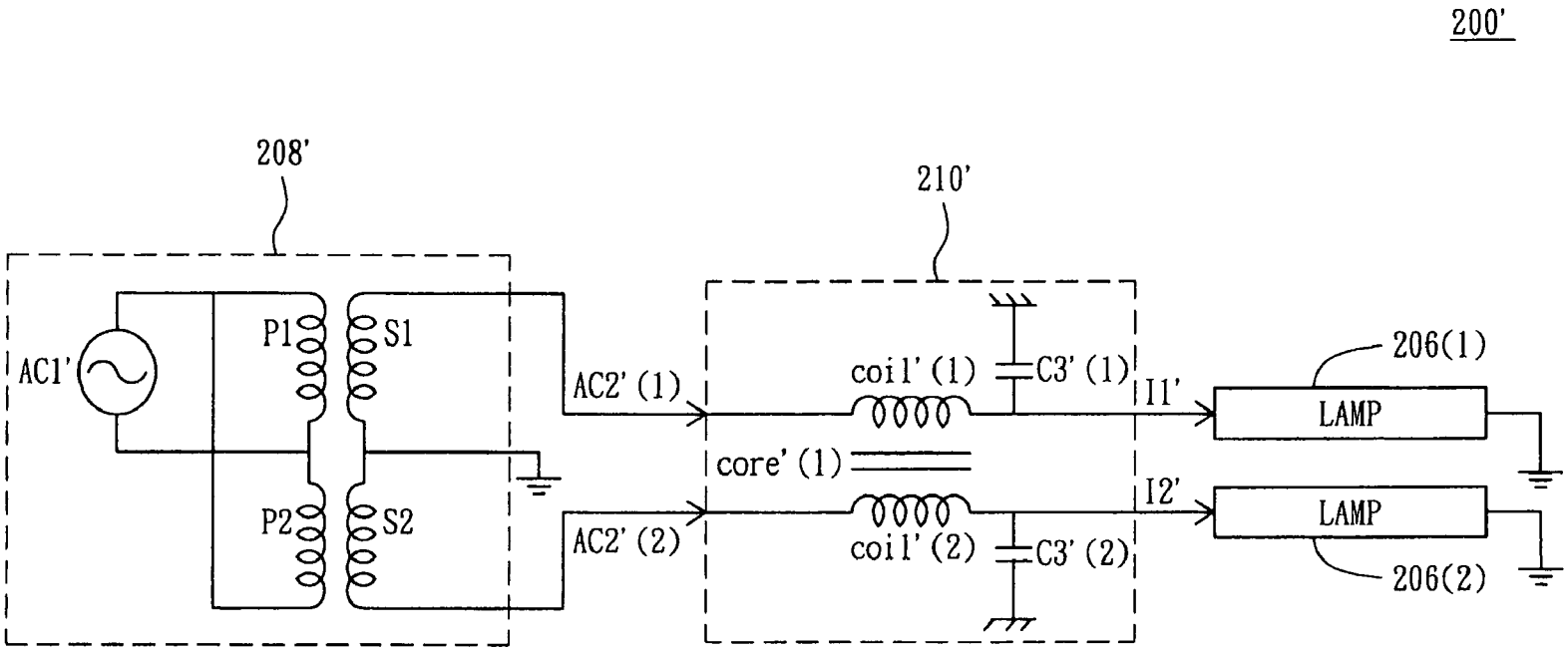
FIG. 15 is a diagram of a third example of the balance circuit 210'.

In FIG. 13, a capacitor C3' can be connected across the two output ends of the balance circuit 210' to achieve a better current balancing effect. Referring to FIG. 14, a diagram of a second example of the balance circuit 210' is shown. Or, referring to FIG. 15, a diagram of a third example of the balance circuit 210' is shown. The capacitor C3' disposed between the two output ends of the balance circuit 210' can also be divided into two capacitors such as the capacitor C3' (1) and the capacitor C3' (2). The capacitor C3' (1) and the capacitor C3' (2) both have one end being coupled to its corresponding output end and the other end being coupled to the ground voltage.

Figure 16:
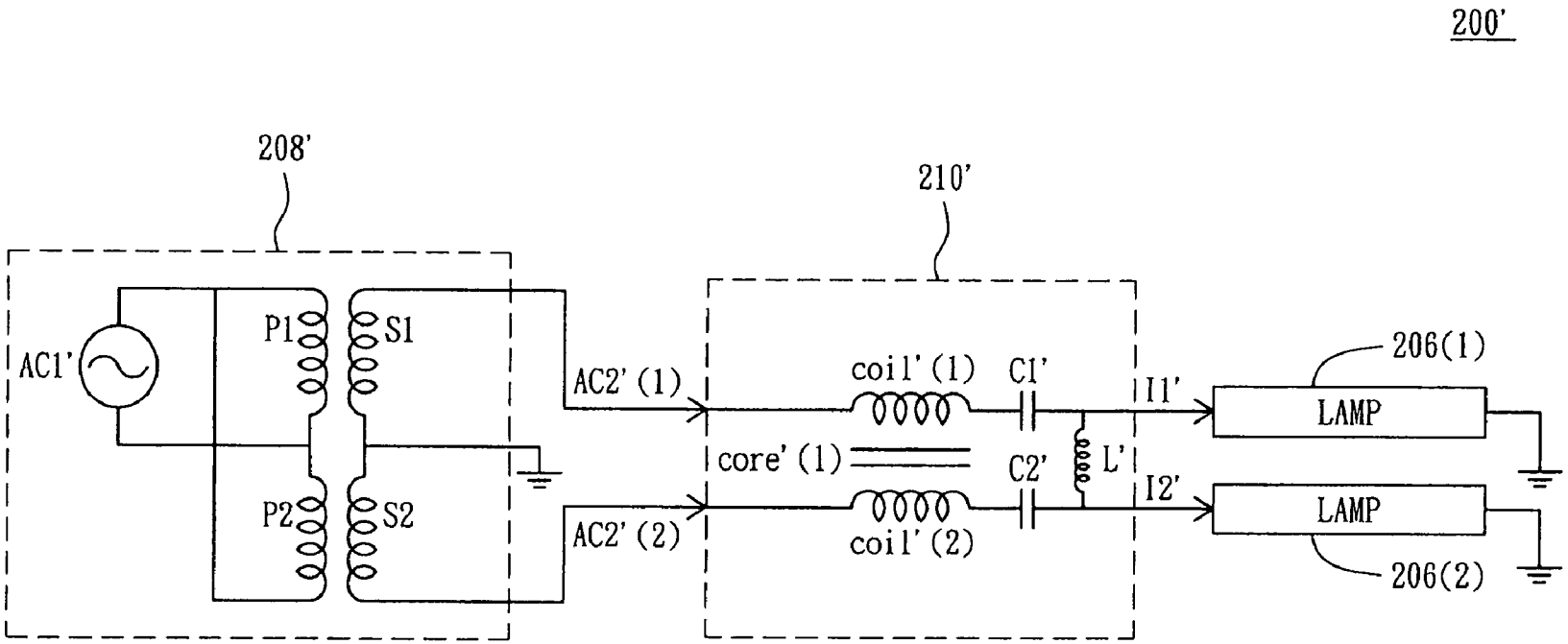
FIG. 16 is a diagram of a fourth example of the balance circuit 210'.

Like the first embodiment, the first coil coil' (1) and the second coil coil' (2) can achieve a better current balancing effect by means of impedance matching. Referring to FIG. 16, a diagram of a fourth example of the balance circuit 210' is shown. The balance circuit 210' further includes an inductor L', a first capacitor C1' and a second capacitor C2'. The other end of the first coil coil' (1) is coupled to one end of the inductor L' via the first capacitor C1'. The other end of the second coil coil' (2) is coupled to the other end of the inductor L' via the second capacitor C2'. The balance circuit 210' outputs the first current I1 and the second current I2 respectively at the two ends of the inductor L'.

Figure 17:
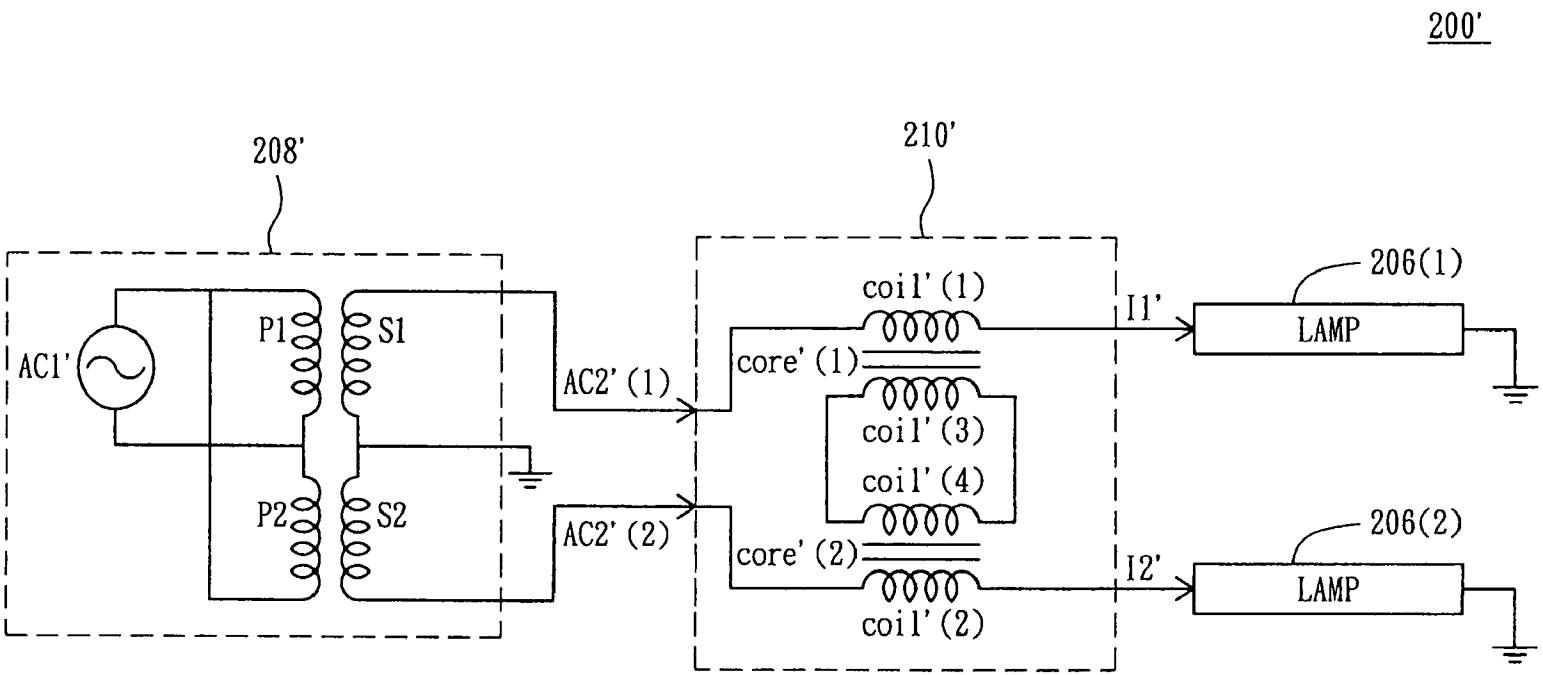
FIG. 17 is a diagram of a fifth example of the balance circuit 210'.

Referring to FIG. 17, a diagram of a fifth example of the balance circuit 210' is shown. Similarly, the example is exemplified by the structure of driving two lamps. The balance circuit 210' further includes a second core core' (2), a third coil coil' (3) and a fourth coil coil' (4). The first coil coil' (1), the second coil coil' (2), the third coil coil' (3) and the fourth coil coil' (4) substantially have the same coil turns. The third coil coil' (3) and the first coil coil' (1) are both wound around the first core core' (1). while the third coil coil' (3) and the fourth coil coil' (4) form a closed loop. The fourth coil coil' (4) and the second coil coil' (2) are both wound around the second core core (2). Similarly, by sharing the same magnetic circuit, that is, the first coil coil' (1) and the second coil coil' (1) share the same magnetic circuit, so that the first coil coil' (1) and the third coil coil' (3) sense the same voltage. Moreover, the third coil coil' (3) and the fourth coil coil' (4) form the same loop and have the same coil turns, so the voltages across the third coil coil' (3) and the fourth coil coil' (4) are the same. Then, the second coil coil' (2) and the fourth coil coil' (4) also share the same magnetic circuit, so that the second coil coil' (2) and the fourth coil coil' (4) sense the same voltage. Lastly, the first current I1' outputted to the first lamp 206 (1) by the first coil coil' (1) and the second current I2 outputted to the first lamp 206 (2) by the second coil coil' (2) would be balanced automatically.

Figure 18:
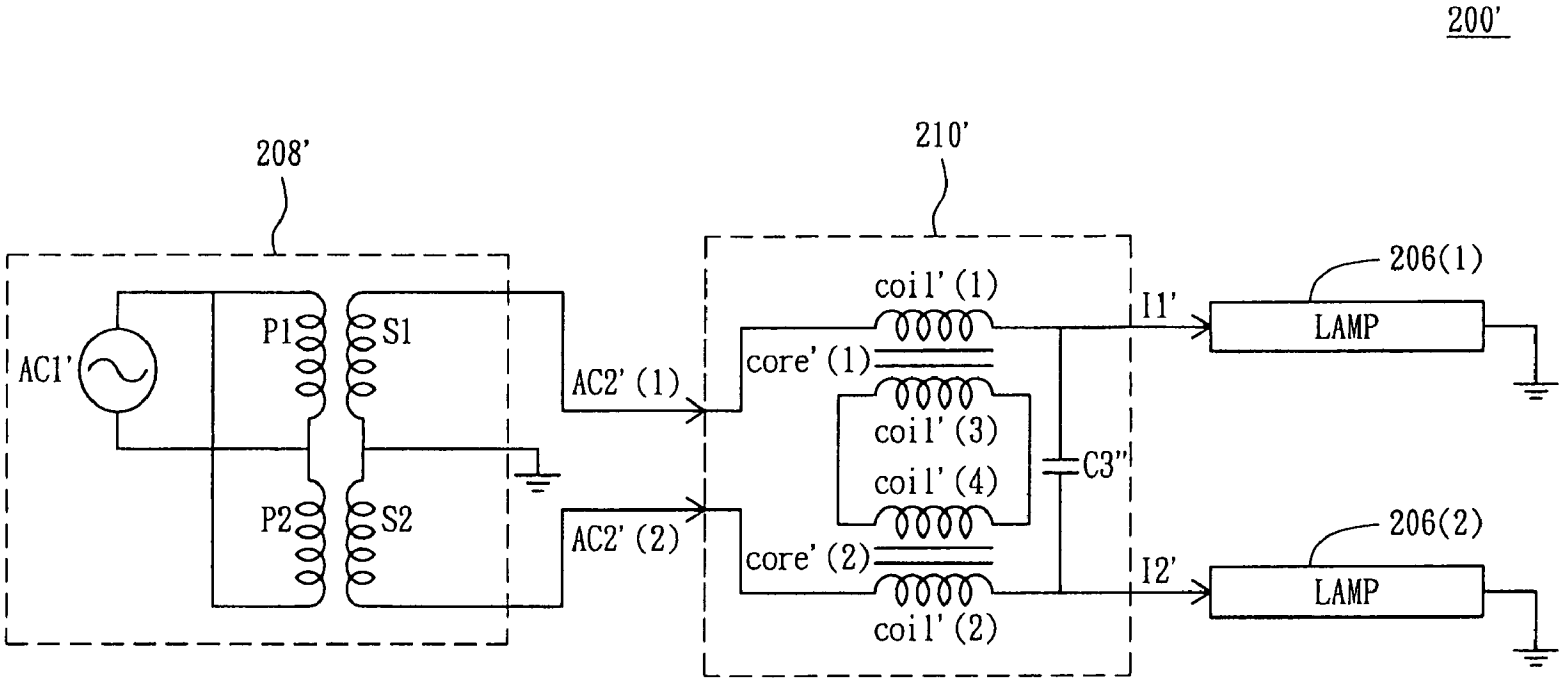
FIG. 18 is a diagram of a sixth example of the balance circuit 210'.
Figure 19:
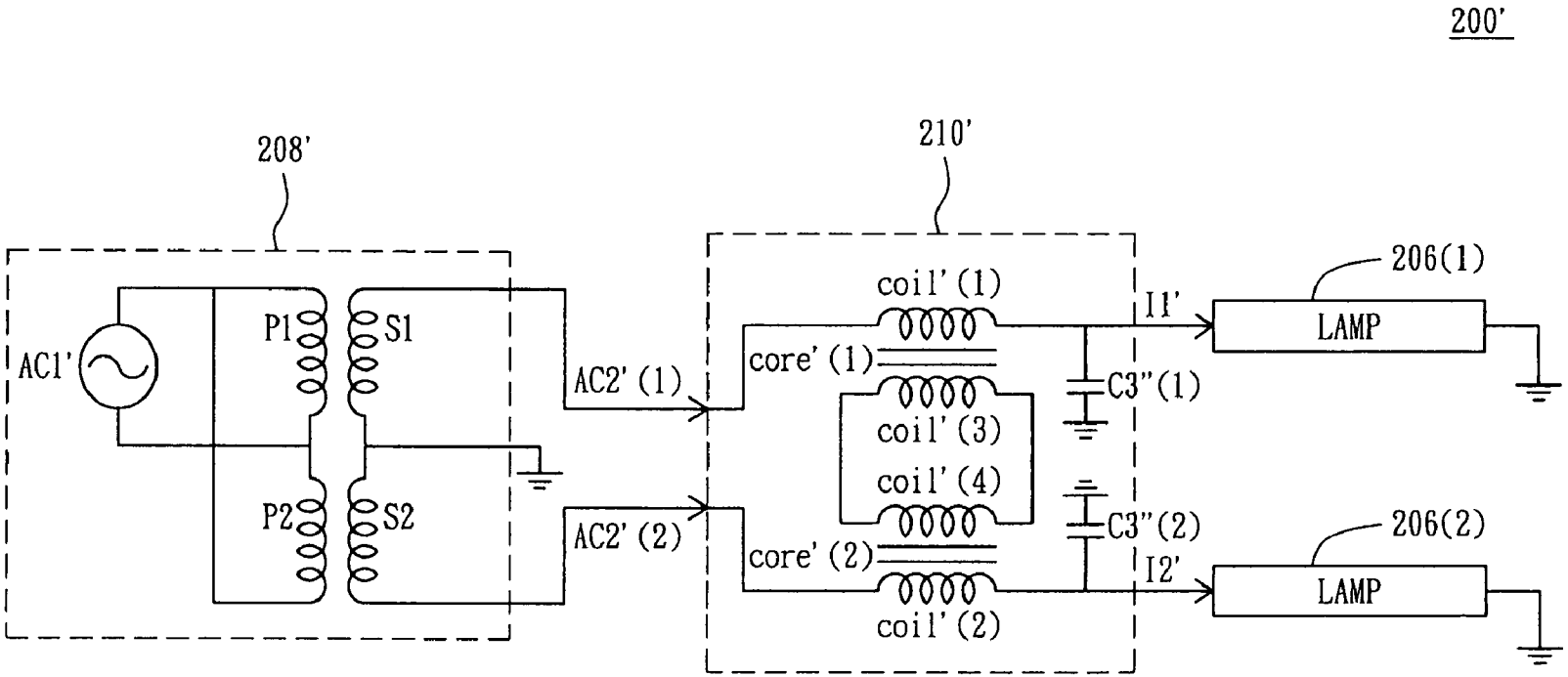
FIG. 19 is a diagram of a seventh example of the balance circuit 210'.

Under the structure of FIG. 17, a capacitor C3" can also be connected across the output ends of the balance circuit 210'. As shown in FIG. 18, a diagram of a sixth example of the balance circuit 210' is shown. The balance circuit 210' further includes a capacitor C3". Or, the capacitor C3" can be divided into two the capacitors C3" (1) and C3" (2). As shown in FIG. 19, a diagram of a seventh example of the balance circuit 210' is shown. The two the capacitors C3" (1) and C3" (2) both have one end being coupled to its corresponding output end and the other end being coupled to the ground voltage.

Figure 20:
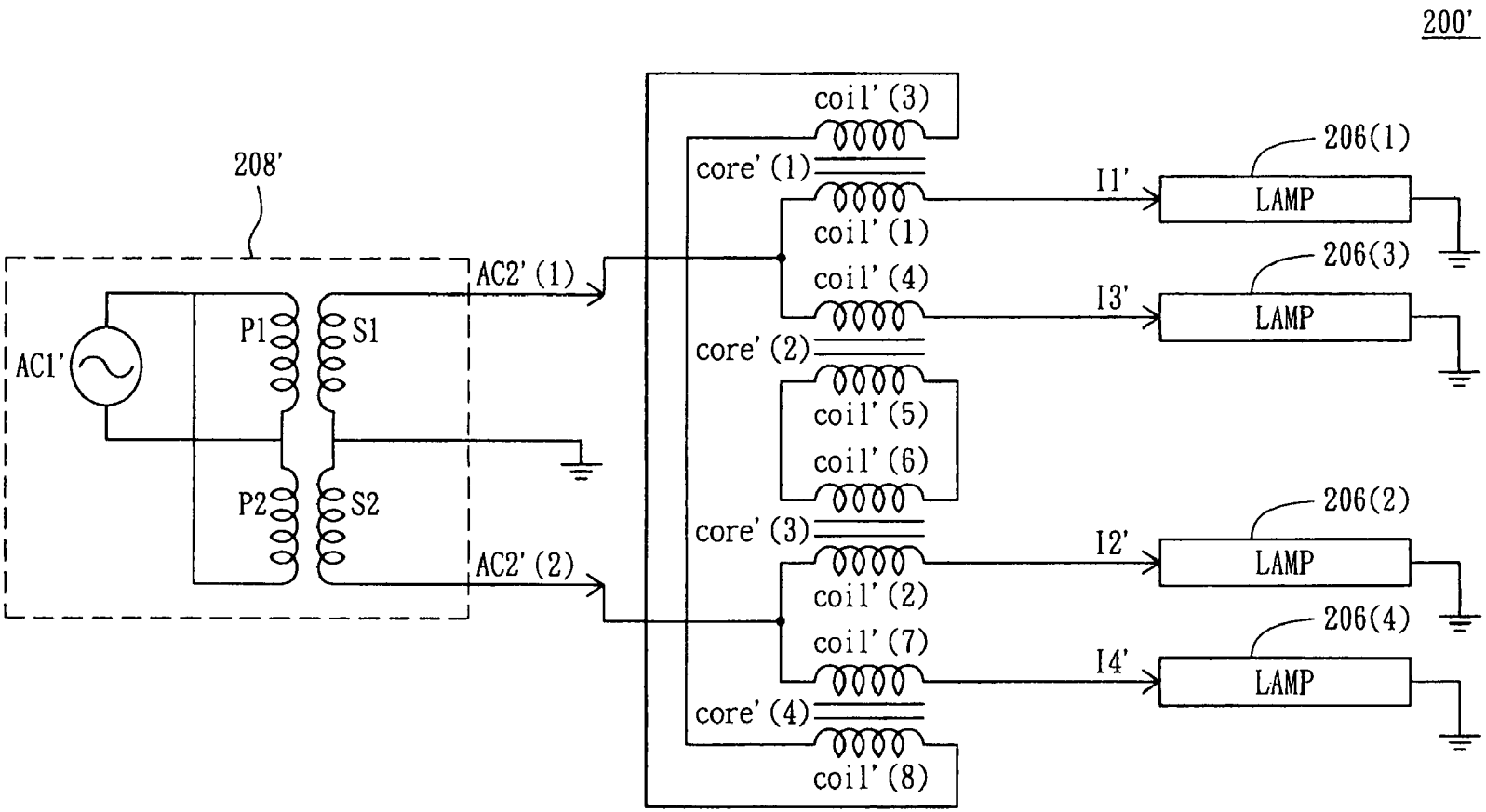
FIG. 20 is a diagram of an eighth example of the balance circuit 210'.

Next, the example is exemplified by the situation of driving four lamps, namely, the first lamp 206 (1), the second lamp 206 (2), the third lamp 206 (3) and the fourth lamp 206 (4). Referring to FIG. 20, a diagram of an eighth example of the balance circuit 210' is shown. The balance circuit 210' further includes four cores (core') and eight coils (coil'). The four core core' namely are the first core core' (1), the second core core' (2), the third core core' (3) and the fourth core core' (4). The eight coils (coil') namely are the first coil coil' (1) and the second coil coil' (2), and the third coil coil' (3), the fourth coil coil' (4), the fifth coil coil' (5), the sixth coil coil' (6), the seventh coil coil' (7) and the eighth coil coil' (8). The coils, coil' (1)~coil' (8), substantially have the same coil turns. Moreover, the first coil coil' (1) and the third coil coil' (3) are both wound around the first core core' (1), the fourth coil coil' (4) and the fifth coil coil' (5) are both wound around the second core core' (2), the sixth coil coil' (6) and the second coil coil' (2) are both wound around the third core core' (3), and the seventh coil coil' (7) and the eighth coil coil' (8) are both wound around the fourth core core' (4). The first coil coil' (1) and the eighth coil coil' (8) form a closed loop. The fifth coil coil' (5) and the sixth coil coil' (6) form another closed loop.

The first coil coil' (1) and the fourth coil coil' (4) both have one end for receiving the second alternate voltage AC2 (1) and the other end for outputting the first current I1' and the third current I3' respectively. The first current I1' is used for driving the first lamp 206 (1). The third current I3' is used for driving the third lamp 206 (3). The second coil coil' (2) and the seventh coil coil' (7) both have one end for receiving the second alternate voltage AC2 (2) and the other end for outputting the second current I2' and the fourth current I4' respectively. The second current I2 is used for driving the second lamp 206 (2). The fourth current I4' is used for driving the fourth lamp 206 (4). According to the above structure, the currents I1~I4 for the four lamps 206 would be balanced.

Figure 21:
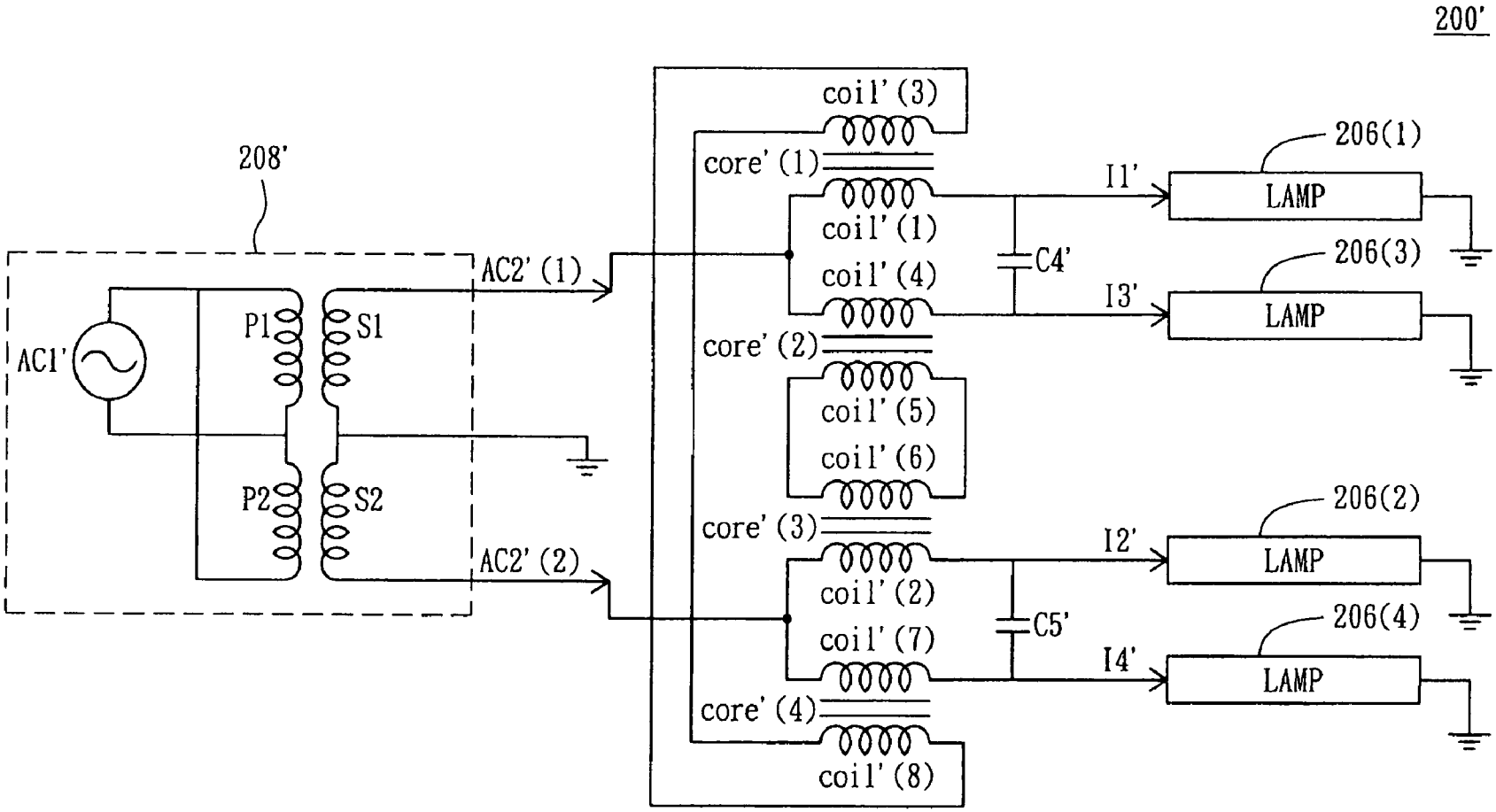
FIG. 21 is a diagram of a ninth example of the balance circuit 210'.
Figure 22:
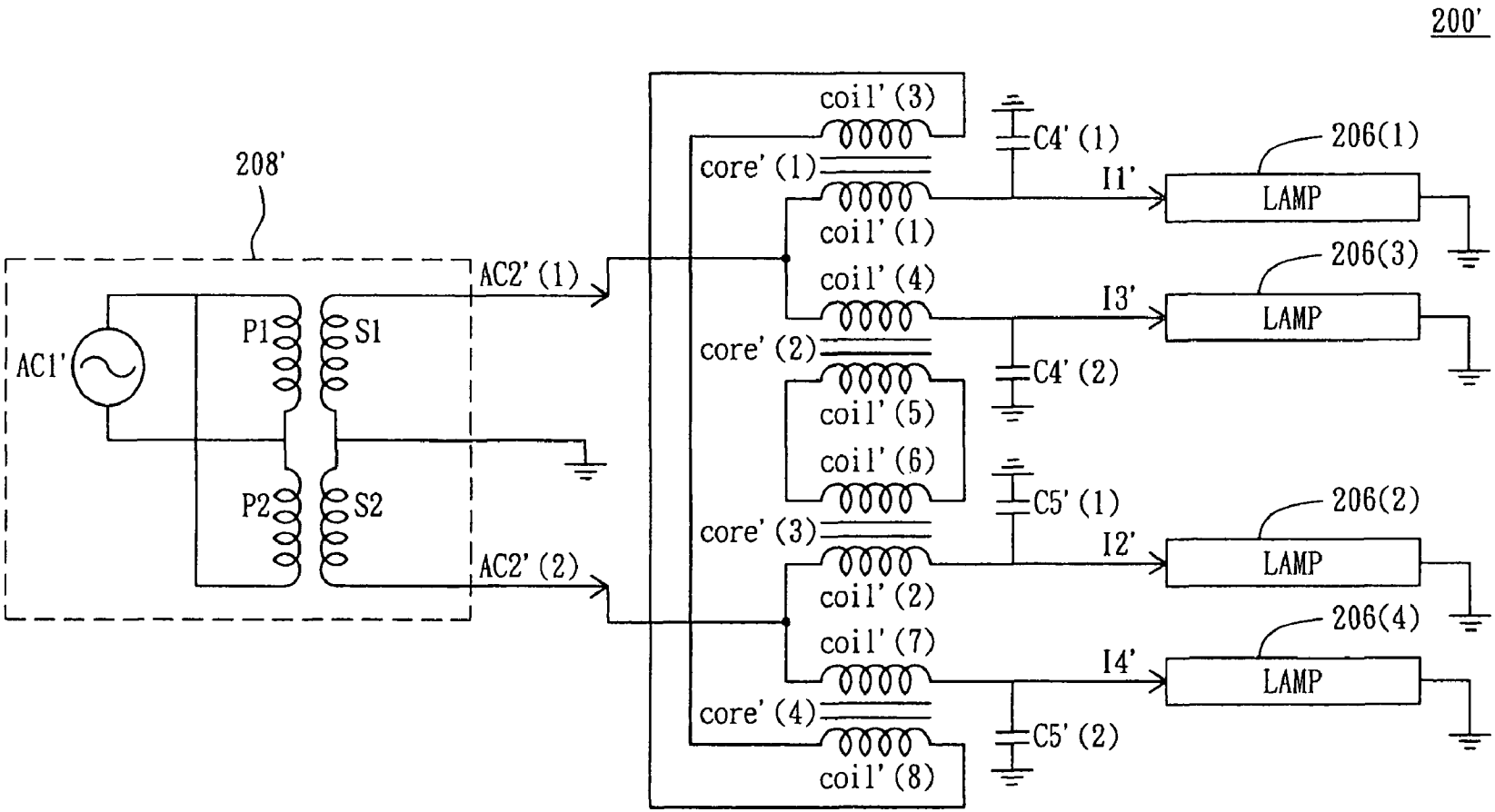
FIG. 22 is a diagram of a tenth example of the balance circuit 210'.

A capacitor can also be connected across the output ends of the balance circuit 210'. For example, FIG. 21, a diagram of a ninth example of the balance circuit 210' is shown. That is, a capacitor C4' is connected across the two output ends of the balance circuit 210' at which the currents I1' and I3' are outputted, and another capacitor C5' is connected across the two output ends of the balance circuit 210' at which the currents I2' and I4' are outputted. Or, as shown in FIG. 22, a diagram of a tenth example of the balance circuit 210' is shown. The capacitor C4' and C5' can respectively be divided into two capacitors. For example, the capacitor C4' is divided into two capacitors C4' (1) and C4' (2). The capacitors C4' (1) and C4' (2) both have one end being coupled to its corresponding output end and the other end being coupled to the ground voltage. The same can be applied to the capacitor C5'. A better current balancing effect can be achieved by having a capacitor be connected across the output ends of the balance circuit 210'.

Figure 23:
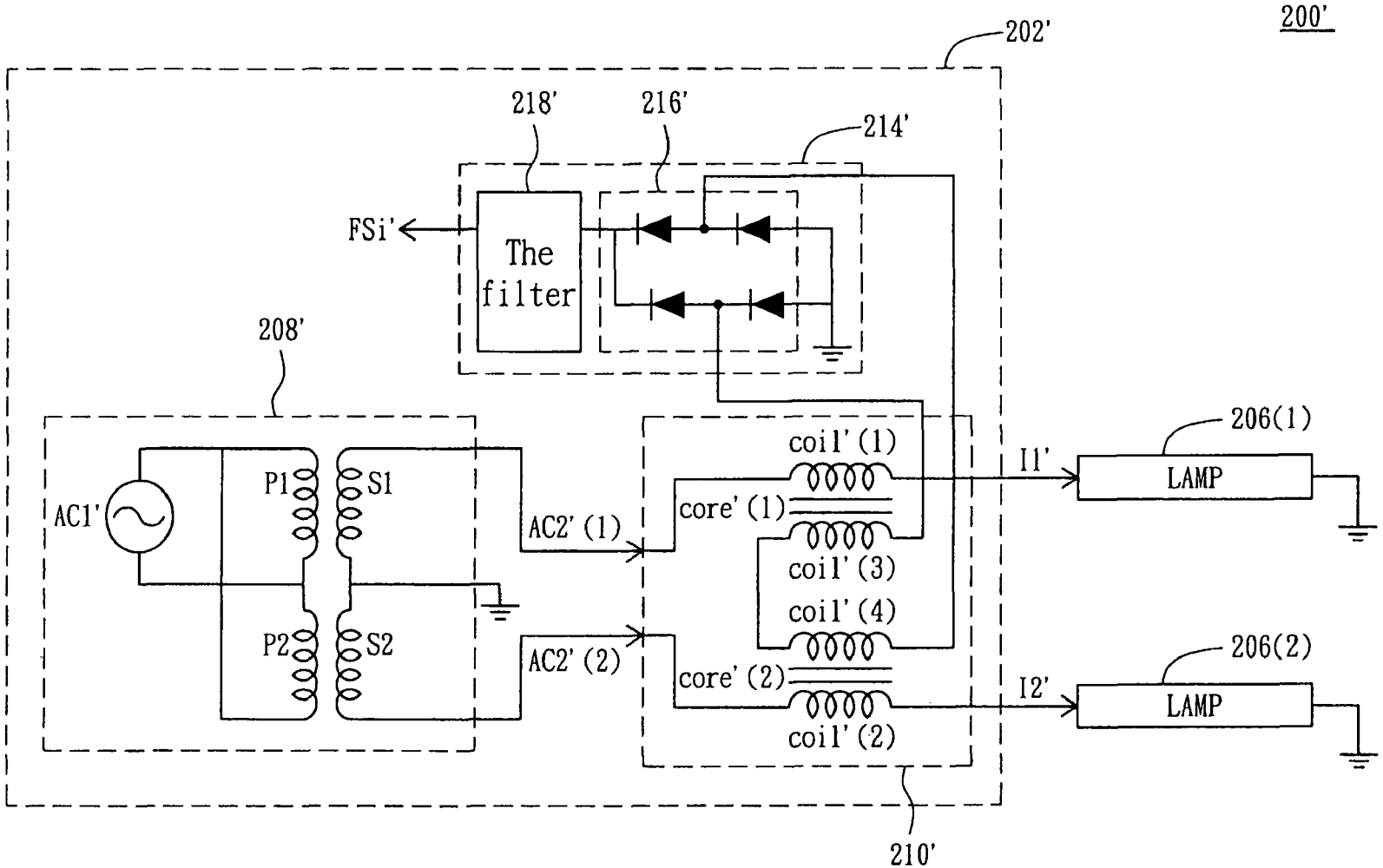
FIG. 23 is a diagram of an example showing a feedback circuit being disposed on a lamp drive circuit 202'.

Next, the circuit feedback is discussed. Referring to FIG. 23, a diagram of an example showing a feedback circuit being disposed on a lamp drive circuit 202' is shown. The lamp drive circuit 202' further includes a feedback circuit 214'. As disclosed above, the feedback circuit 214' is for outputting a feedback signal FSi' according to the electric signal required for driving the lamp 206. The lamp drive circuit 202' adjusts the operating period of the switch 212 according to the feedback signal FSi, so that the lamp 206 can achieve the required luminance and maintain stable. In the balance circuit 210', part of the coils (coil') forms a closed loop. For example, the structures disclosed in FIG. 17 to FIG. 20 all form at least a closed loop. The required electric signal is obtained from the closed loops and converted into the feedback signal FSi'. For example, in FIG. 23, the feedback circuit 214' can obtain the required electric signal from the loop formed by the third coil coil' (3) and the fourth coil coil' (4) in FIG. 17, that is, the voltage difference between the third coil coil' (3) and the fourth coil coil' (4), so as to output the corresponding feedback signal FSi' and achieve the above object.

As is stated in the last paragraph of the first embodiment, the impedance of the coil needs to be considered. A certain corresponding relationship exists between each coil (coil) and the impedance of the lamp. It is known from experiment that when the impedance of the coil is far larger than the impedance of the lamp, the balance effect becomes even better. However, the larger the impedance of the coil is, the more power consumption will be. The impedance of the coil must be larger than the impedance of the lamp at least by ⅕, so as to achieve a certain level of balance effect of the currents.

The lamp drive circuit disclosed in the above embodiments of the invention enables each of the lamps to be electrically connected to a coil in serial, the coils substantially have the same coil turns and have the same magnetic circuit so that the currents flowing through the lamps are balanced. It does not matter whether the balance circuit has a single-end input or a double-end input, and the transformer for boosting/reducing the voltage can be a single transformer or several transformers connected in parallel. The light source provided to the liquid crystal display panel by the backlight module has an even uniformed luminance and the currents for the lamp are even more balanced so that the durability of the lamp is further prolonged.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lamp drive circuit used for driving a plurality of lamps comprising a first lamp, a second lamp, a third lamp, and a fourth lamp, wherein the lamp drive circuit comprises:

a power supply circuit comprising a first output terminal and a second output terminal used for providing an alternate voltage;

a first balance circuit, coupled to the first output terminal, for driving at least the first lamp and the second lamp, the first balance circuit comprising:

a first coil, wherein one end of the first coil is coupled to the first output terminal and the other end of the first coil is coupled to the first lamp; and a second coil, wherein one end of the second coil is coupled to the first output terminal and the other end of the second coil is coupled to the second lamp;

wherein a voltage across the first coil of the first balance circuit corresponds to a voltage across the second coil of the first balance circuit; and a second balance circuit, coupled to the second output terminal, for driving at least the third lamp and the fourth lamps, the second balance circuit comprising:

a first coil, wherein one end of the first coil is coupled to the second output terminal and the other end of the first coil is coupled to the third lamp; and a second coil, wherein one end of the first coil is coupled to the second output terminal and the other end of the second coil is coupled to the fourth lamp;

wherein a voltage across the first coil of the second balance circuit corresponds to a voltage across the second coil of the second balance circuit.

2. The lamp drive circuit according to claim 1, wherein the first balance circuit further comprises:

a core, wherein both the first coil and the second coil are wound around the core, and the coil turns of the first coil are substantially equal to the coil turns of the second coil.

3. The lamp drive circuit according to claim 2, wherein an impedance of the first coil of the first balance circuit corresponds to an impedance of the first lamp, and an impedance of the second coil of the first balance circuit corresponds to an impedance of the second lamp.

4. The lamp drive circuit according to claim 2, wherein the first balance circuit further comprises:

a first inductor;

a first capacitor, wherein the other end of the first coil of the first balance circuit is coupled to one end of the first inductor via the first capacitor; and a second capacitor, wherein the other end of the second coil of the first balance circuit is coupled to the other end of the first inductor via the second capacitor.

5. The lamp drive circuit according to claim 1, wherein for the first balance circuit, the coil turns of the first coil are substantially equal to the coil turns of the second coil, the first balance circuit further comprises:

a first core;

a second core;

a third coil, wherein the coil turns of the third coil are substantially equal to the coil turns of the first coil of the first balance circuit, and the third coil and the first coil are both wound around the first core; and a fourth coil, wherein the third coil and the fourth coil form a closed loop, the coil turns of the fourth coil are substantially equal to the coil turns of the first coil, and the fourth coil and the second coil are both wound around the second core.

6. The lamp drive circuit according to claim 5, wherein the first balance circuit further comprises:

a capacitor coupled to the other end of the first coil of the first balance circuit and the other end of the second coil of the first balance circuit.

7. The lamp drive circuit according to claim 5, wherein the first balance circuit further comprises:

a first capacitor, wherein the other end of the first coil of the first balance circuit is coupled to a fixed voltage via the first capacitor; and a second capacitor, wherein the other end of the second coil of the first balance circuit is coupled to the fixed voltage via the second capacitor.

8. The lamp drive circuit according to claim 5, further comprising:

a feedback circuit for outputting a feedback signal according to a voltage difference between one end of the third coil and one end of the fourth coil;

wherein the power supply circuit outputs the alternate voltage according to the feedback signal.

9. The lamp drive circuit according to claim 8, wherein the feedback circuit comprises:

a full-wave rectifying circuit for rectifying and outputting the voltage difference; and a filter for filtering the noises of the rectified voltage difference to become the feedback signal.

10. The lamp drive circuit according to claim 8, wherein the feedback circuit comprises:

a half-wave rectifying circuit for rectifying and outputting the voltage difference; and a filter for filtering the noises of the rectified voltage difference to become the feedback signal.

11. The lamp drive circuit according to claim 1, further used for driving a fifth lamp of the plurality of lamps, wherein the first balance circuit further comprises:

a first core;

a second core;

a third core;

a third coil, wherein the coil turns of the third coil are substantially equal to the coil turns of the first coil of the first balance circuit, and the third coil and the first coil are both wound around the first core;

a fourth coil, wherein one end of the fourth coil is coupled to the first output terminal and the other end of the fourth coil is coupled to the fifth lamp, and the coil turns of the fourth coil are substantially equal to the coil turns of the first coil of the first balance circuit;

a fifth coil, wherein the coil turns of the fifth coil are substantially equal to the coil turns of the fourth coil, and the fifth coil and the fourth coil are both wound around the second core; and a sixth coil, wherein the coil turns of the sixth coil are substantially equal to the coil turns of the second coil of the first balance circuit, and the sixth coil and the second coil are both wound around the third core;

wherein the third coil, the fifth coil and the sixth coil form a closed loop, and the coil turns of the first coil of the first balance circuit are substantially equal to the coil turns of the second coil of the first balance circuit.

12. The lamp drive circuit according to claim 11, wherein the first balance circuit further comprises:

a first capacitor coupled to the other end of the first coil of the first balance circuit and the other end of the fourth coil; and a second capacitor coupled to the other end of the fourth coil and the other end of the second coil of the first balance circuit.

13. The lamp drive circuit according to claim 11, further comprising:

a feedback circuit for outputting a feedback signal according to a voltage difference between one end of the third coil and one end of the sixth coil;

wherein the power supply circuit outputs the alternate voltage according to the feedback signal.

14. The lamp drive circuit according to claim 13, wherein the feedback circuit comprises:

a full-wave rectifying circuit for rectifying and outputting the voltage difference; and a filter for filtering the noises of the rectified voltage difference to become the feedback signal.

15. The lamp drive circuit according to claim 13, wherein the feedback circuit comprises:

a half-wave rectifying circuit for rectifying and outputting the voltage difference; and a filter for filtering the noises of the rectified voltage difference to become the feedback signal.

16. The lamp drive circuit according to claim 1, wherein the power supply circuit comprises:

a transformer for outputting the alternate voltage.

* * * * *